US010786889B2

(12) United States Patent
Nammoto

(10) Patent No.: US 10,786,889 B2
(45) Date of Patent: Sep. 29, 2020

(54) ADJUSTABLE WRENCH

(71) Applicant: Southern Handling and Delivery, LLC, Coral Gables, FL (US)

(72) Inventor: Yuji Nammoto, Coral Gables, FL (US)

(73) Assignee: Southern Handling and Delivery, LLC, Coral Gables, FL (US)

( * ) Notice: Subject to any disclaimer, the term of this patent is extended or adjusted under 35 U.S.C. 154(b) by 0 days.

(21) Appl. No.: 15/718,569

(22) Filed: Sep. 28, 2017

(65) Prior Publication Data

US 2018/0021928 A1 Jan. 25, 2018

Related U.S. Application Data

(63) Continuation-in-part of application No. 15/149,227, filed on May 9, 2016, now Pat. No. 9,833,882, and a continuation-in-part of application No. PCT/US2017/031508, filed on May 8, 2017.

(51) Int. Cl.

| | |
|---|---|
| ***B25B 23/00*** | (2006.01) |
| ***B25B 13/46*** | (2006.01) |
| ***B25B 13/14*** | (2006.01) |
| ***B25B 13/16*** | (2006.01) |

(52) U.S. Cl.

CPC ..... *B25B 23/0021* (2013.01); *B25B 13/14* (2013.01); *B25B 13/16* (2013.01); *B25B 13/46* (2013.01); *B25B 23/0007* (2013.01)

(58) Field of Classification Search

CPC ..... B25B 13/14; B25B 23/0021; B25B 13/16; B25B 13/46; B25B 23/0007; B25B 13/12; B25B 13/5058

See application file for complete search history.

(56) References Cited

U.S. PATENT DOCUMENTS

| | | | |
|---|---|---|---|
| 1,608,432 | A | 11/1926 | Ryan |
| 2,470,007 | A | 5/1949 | Watson |
| 2,659,258 | A | 11/1953 | Dillard |
| 2,716,367 | A | 8/1955 | Montgomery |

(Continued)

FOREIGN PATENT DOCUMENTS

| | | |
|---|---|---|
| FR | 610584 | 9/1926 |
| GB | 134504 | 11/1919 |

(Continued)

OTHER PUBLICATIONS

International Search Report for PCT/US2017/031508 dated Aug. 17, 2017.

(Continued)

*Primary Examiner* — Brian D Keller

(74) *Attorney, Agent, or Firm* — Fleit Intellectual Property Law; Gary S. Winer; Paul D. Bianco

(57) ABSTRACT

A wrench, connectable to a standard square shaped extension, has a wrench head with opposed jaw faces which together define a plane that lies perpendicular to the respective jaw faces. A standard square shaped extension socket is affixed to the wrench head, where a standard square shaped extension can be inserted into the standard extension socket, along a direction that is non-orthogonal to the transverse plane. The standard extension socket can be attached to a frame of the wrench head, or to a rotatable guide which controls movement the opposed jaw face which is movable.

13 Claims, 11 Drawing Sheets

(56) References Cited

U.S. PATENT DOCUMENTS

| | | | | | |
|---|---|---|---|---|---|
| 3,062,079 | A | * | 11/1962 | Davis | B25B 13/08 81/129 |
| 3,318,176 | A | | 5/1967 | Geier | |
| 3,877,328 | A | | 4/1975 | Sullivan | |
| 4,651,159 | A | | 3/1987 | Ness | |
| 4,651,597 | A | | 3/1987 | Yang | |
| 4,757,729 | A | * | 7/1988 | Martinmaas | B25B 13/44 81/128 |
| 4,967,613 | A | * | 11/1990 | Cone | B25B 13/16 81/166 |
| 4,987,805 | A | * | 1/1991 | Ejdenwik | B25B 13/12 81/155 |
| 5,074,171 | A | | 12/1991 | Annis | |
| 5,103,697 | A | * | 4/1992 | Masbaum | B25B 13/24 81/148 |
| 5,239,899 | A | | 8/1993 | Baker | |
| 5,595,098 | A | | 1/1997 | Malkin | |
| 5,685,205 | A | | 11/1997 | Suksi | |
| 5,746,097 | A | | 5/1998 | McCann | |
| 5,862,722 | A | | 1/1999 | Cislo | |
| 5,884,539 | A | | 3/1999 | Baker | |
| 5,894,768 | A | | 4/1999 | Malkin | |
| 5,960,683 | A | | 10/1999 | Malkin et al. | |
| 5,988,024 | A | * | 11/1999 | Boyd | B25B 13/16 81/166 |
| 6,000,301 | A | * | 12/1999 | Hillinger | B25B 13/16 81/166 |
| 6,016,723 | A | * | 1/2000 | Hillinger | B25B 13/12 81/166 |
| 6,112,625 | A | * | 9/2000 | Turtle | B25B 23/0021 81/177.1 |
| D473,768 | S | * | 4/2003 | Gilmore | D8/28 |
| 6,748,827 | B2 | * | 6/2004 | Huang | B25B 13/16 81/129 |
| 7,114,416 | B2 | | 10/2006 | Hasegawa | |
| 9,381,628 | B1 | * | 7/2016 | Garza | B25G 1/043 |
| 2007/0131070 | A1 | * | 6/2007 | Hull | B25B 13/461 81/489 |
| 2010/0083798 | A1 | | 4/2010 | Tai | |
| 2012/0000319 | A1 | | 1/2012 | Armstrong | |

FOREIGN PATENT DOCUMENTS

| | | | |
|---|---|---|---|
| RU | 78455 | U1 | 11/2008 |
| WO | 20110146081 | A1 | 11/2011 |
| WO | 2017196706 | A1 | 11/2017 |

OTHER PUBLICATIONS

Written Opinion for PCT/US2017/031508 dated Aug. 17, 2017.
Ebay—2PCS-Multi-function-Adjustable-Universal-Quick-Snap-Grip-Wrench-Tool-Spanner-Set, 5 pgs, http://www.ebay.com/itm—retrieved Feb. 23, 2016.
Crescent Folding Ratcheting Wrench Set, http://toolguyd.com/crescent-folding-ratcheting-wrench-set/—2pgs, retrieved May 6, 2016.
HK1 Hydrokinetic Adjustable Wrench—Cool Tools—http://www.amazon.com, 1 pg, retrieved Mar. 3, 2015.
HK1 Hydrokinetic Adjustable Wrench—http://www.werd.com, 2 pgs, retrieved Mar. 3, 2015.
Husky Total Socket,Cam-Tech Industries, Inc., http://toolguyd.com, 2 pgs, retrieved May 6, 2016.
Skil Ratcheting Adjustable Wrench, http://toolguyd.com, 2 pgs, retrieved May 6, 2016.
Skil Speed Slide Wrench, http://toolguyd.com, 2 pgs, retrieved May 6, 2016.
Stahlwille FastRatch 240 Ratcheting-Action Wrenches, http://toolguyd.com, 3 pgs, retrieved May 6, 2016.
Craftman Adjustable Wrench1—https://www.google.com, 1 pg, retrieved Aug. 25, 2015.
Craftman Adjustable Wrench 2—https://www.google.com, 1 pg, retrieved Aug. 25, 2015.
Lee Valley Tools—http://www.leevalley.com—Socket Wrench Extension Sets, pg. 1—retrieved Feb. 20, 2017.
TEKTON 2580—https://www.amazon.com ⅜-Inch Drive Crowfoot Wrench Set 10 piece, retrieved Aug. 8, 2017.
H5 Open End Interchangeable Torque Wrench Head, https://www.grainger.com; 4-1/16 L 2400_inch Max Torque 4NAV4-JH5-23M-Grainger, retrieved Aug. 8, 2017.
9 × 12 Open End Interchangeable Torque Wrench Head, https://www.grainger.com; 1-19/32L-30ft-lb Max Torque-19ZC68_19ZG68-Grainger retrieved Aug. 8, 2017.
Standard Interchangeable Drive Ends, https://www.belknaptools.com; Van F Belknap mpany retrieved Aug. 8, 2017.
Spartan Plumber Magazine—https://www.plumbermag.com—Adapter turns ratchet drive or breaker bar into a pipe wench; retrieved Aug. 8, 2017.
Bestool-Kanon—https://www.bestool-kanon.cojp—LCK Adjustable replaceable head torque wrench; retrieved Aug. 8, 2017.
Facom-b-font-13-plum-torque-font-b-wrench-b-font-replacement head—https://ae01.alicdn.com/kf/HTB1LZCYLp—retrieved Aug. 8, 2017.
TEKTON wrench—https://www.jt-architecture.com/bidding/photos/P106022—retrieved Aug. 8, 2017.
MXITA—Adjustable Ended Insert Tools—https://ae01.alicdn.com/kf/HTB14lg0p—retrieved Aug. 8, 2017.
MXITA Torque Wrench—https://www.aliexpress.com/store/product/Adjustable-head-torque-Wrench—retrieved Aug. 8, 2017.
Stahlwille Torque Wrench Replacement Head—https://www.lelong.com.my/stahwille-735-20-torque- wrench-replacement—retrieved Aug. 8, 2017.
TOHNICHI—https://img.alicdn.com/bao—retrieved Aug. 8, 2017.
International Preliminary Report and Written Opinion for PCT/US2017/031508 dated Nov. 22, 2018.
European Search Report for EP application No. 17796616.5 dated Dec. 5, 2019.

* cited by examiner

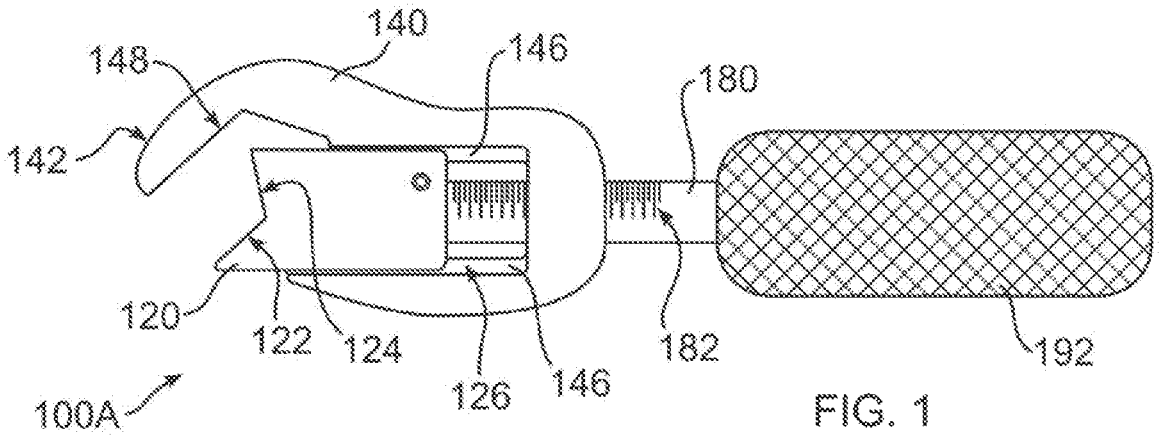
FIG. 1
FIG. 2
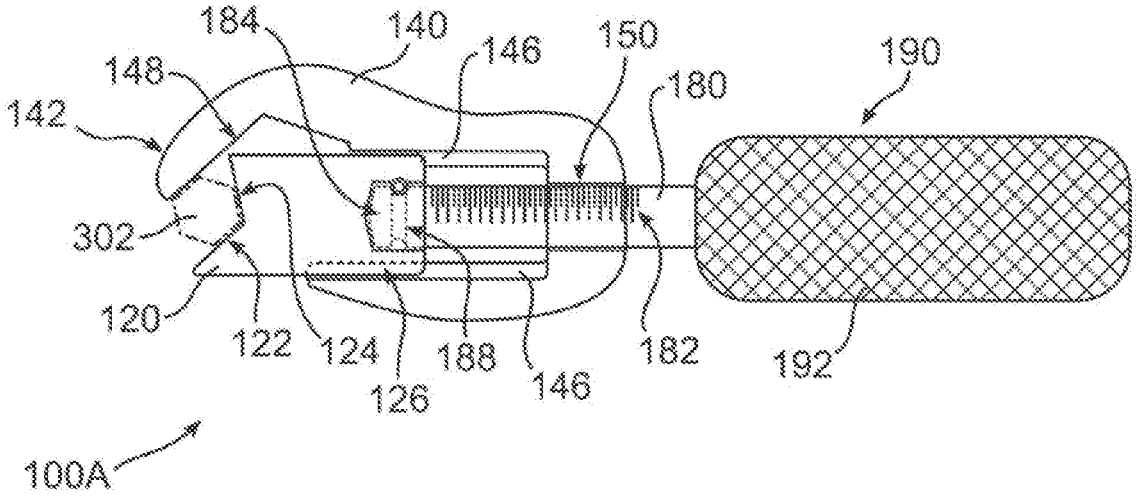
FIG. 3
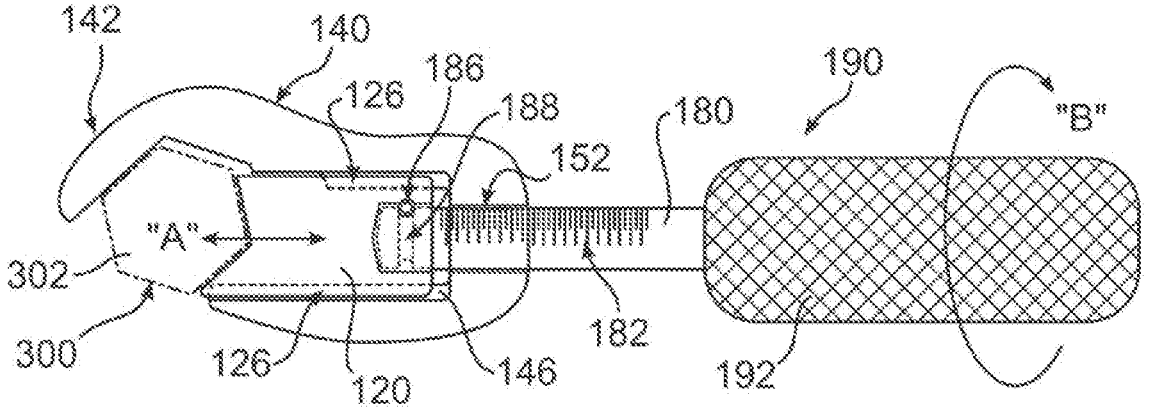

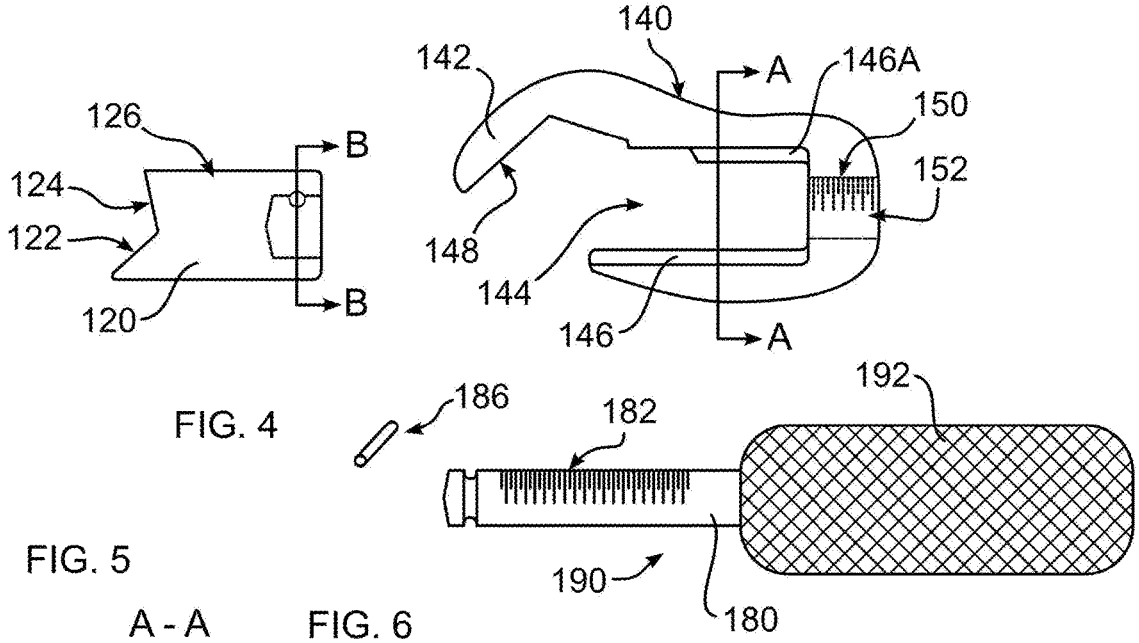
FIG. 4
FIG. 5
A - A
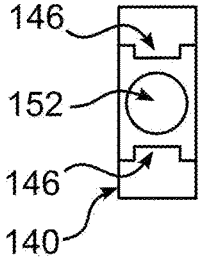
FIG. 6
B - B
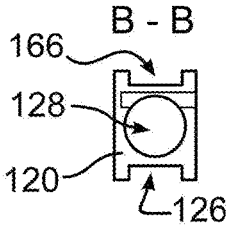
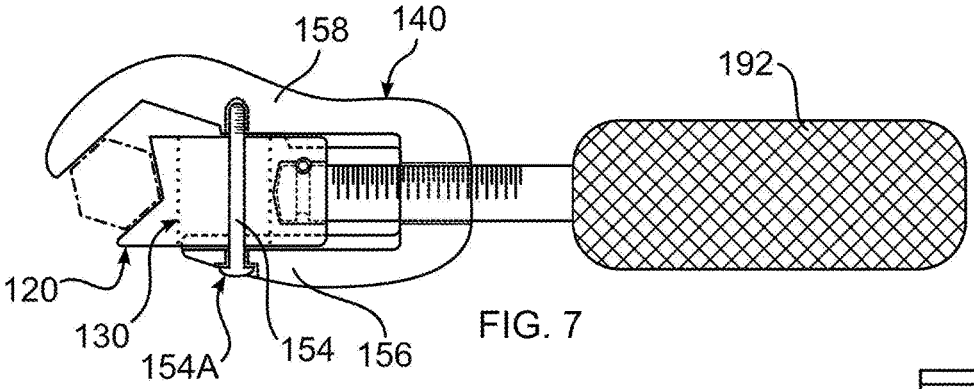
FIG. 7
FIG. 8
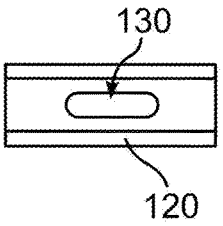
FIG. 9
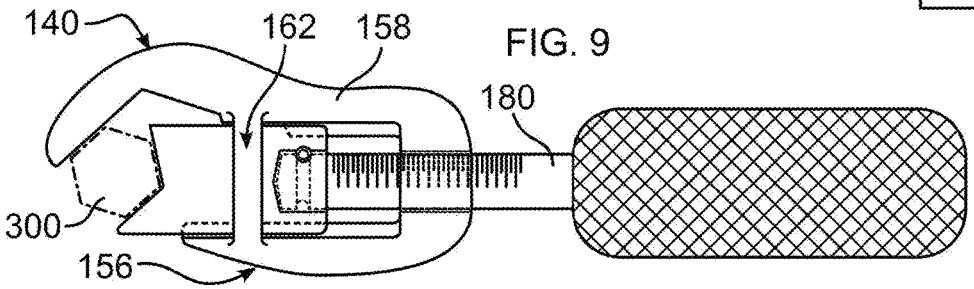

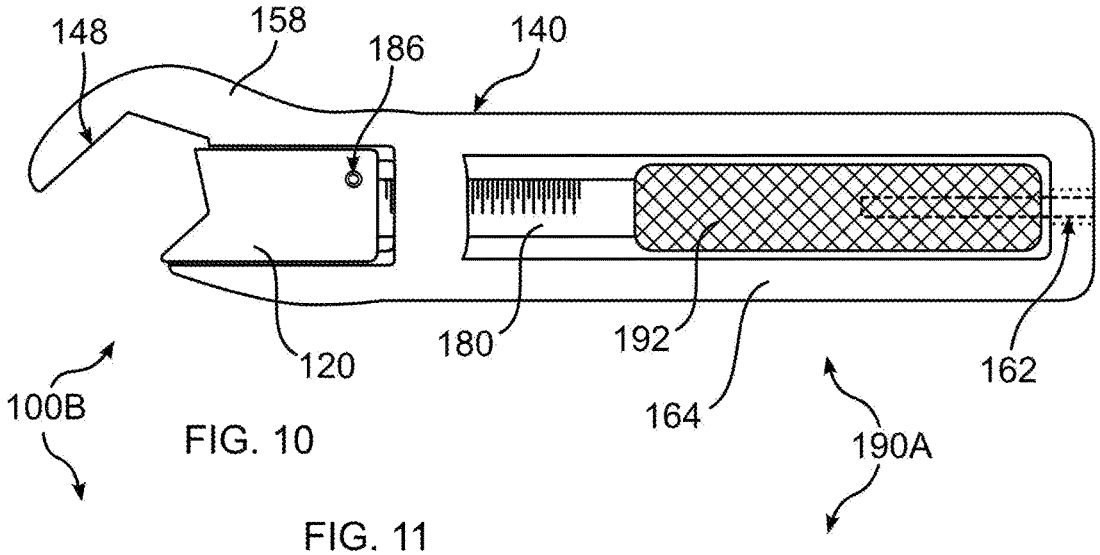
FIG. 10
FIG. 11
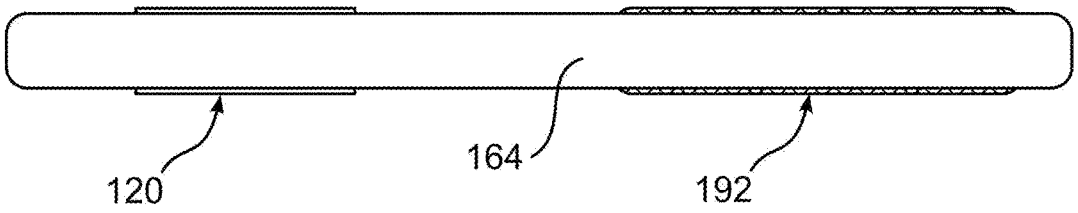
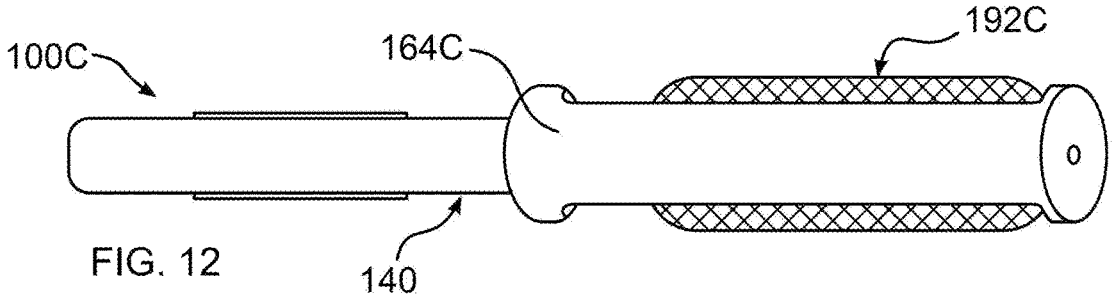
FIG. 12
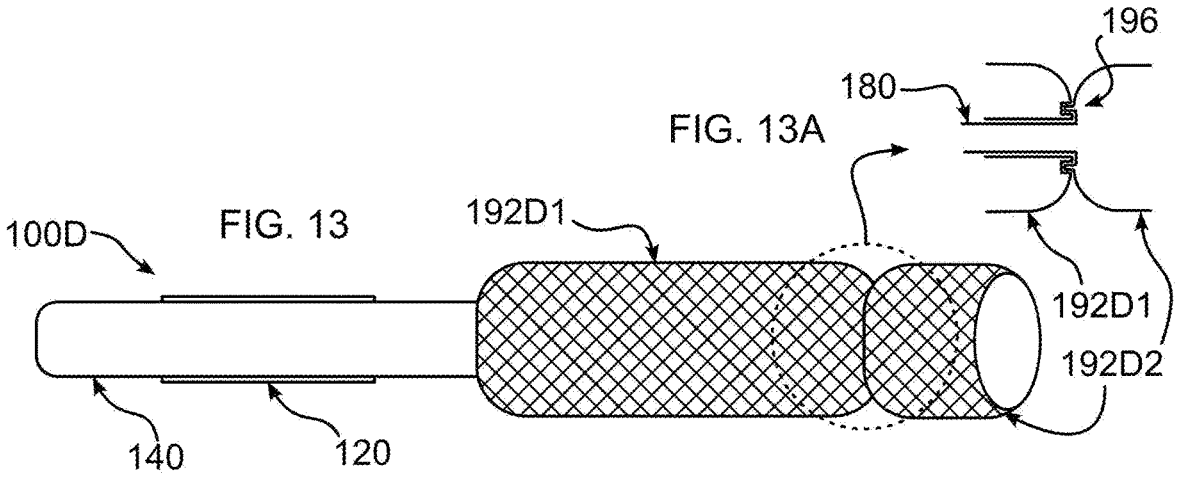
FIG. 13A
FIG. 13

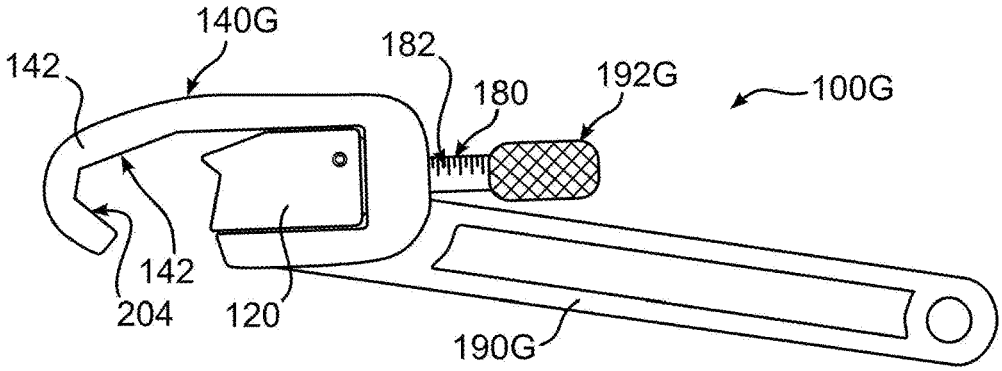
FIG. 19
FIG. 20
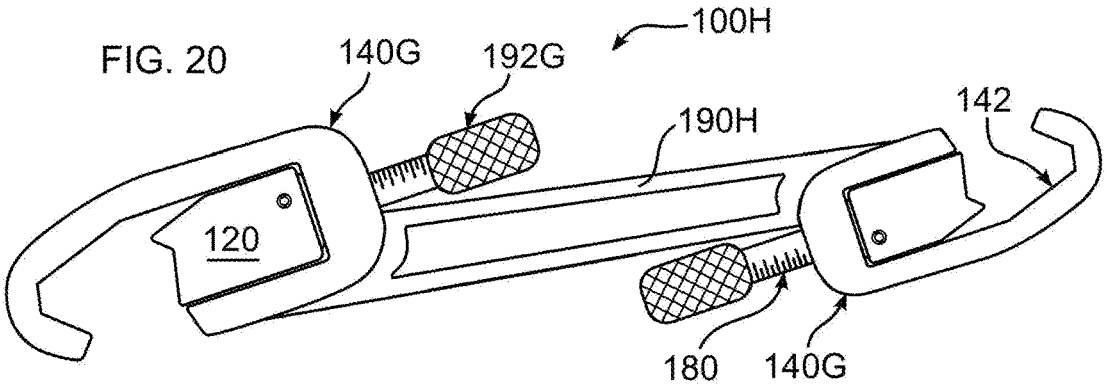
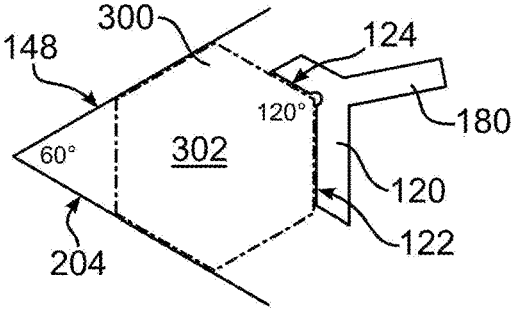
FIG. 21A
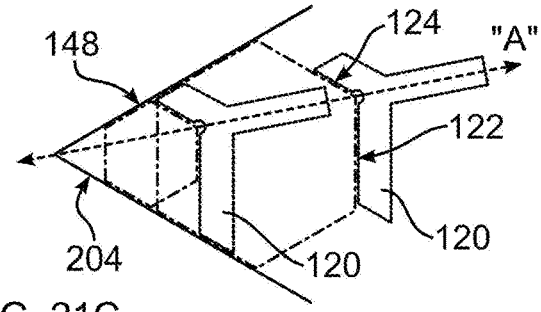
FIG. 21C
FIG. 21B
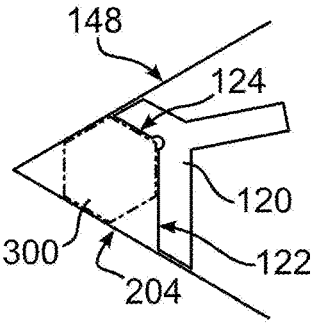
FIG. 21D
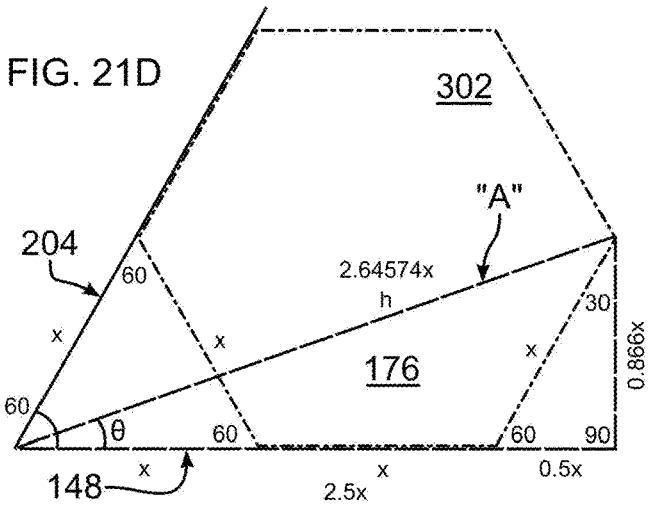

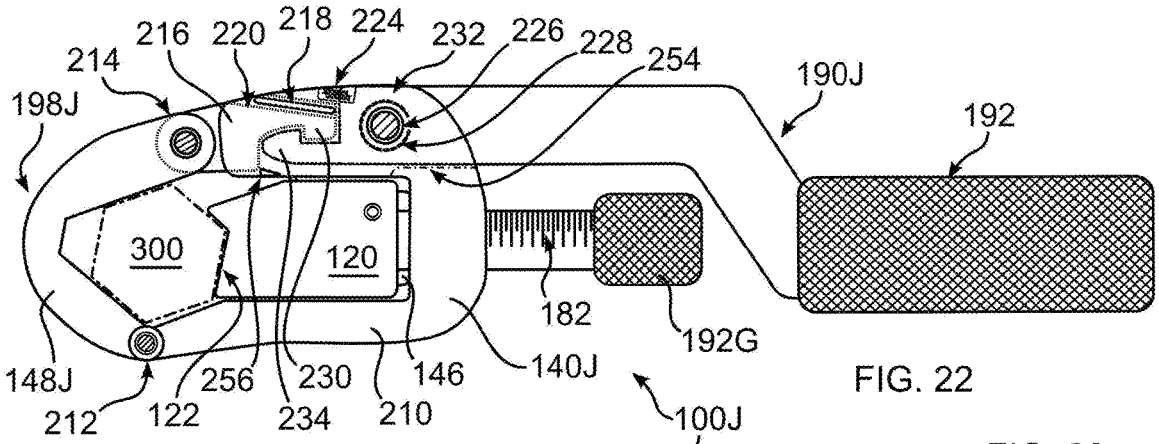
FIG. 22
FIG. 23
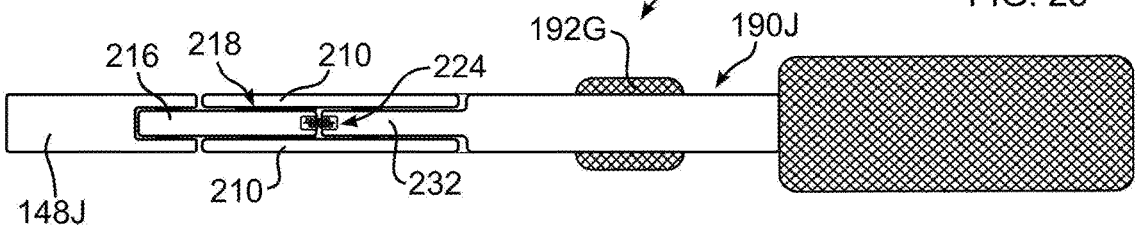
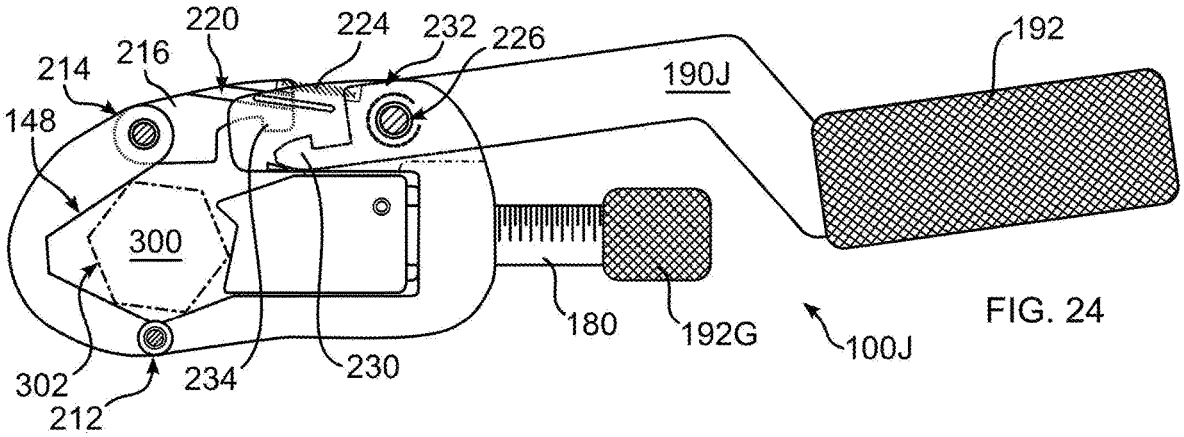
FIG. 24
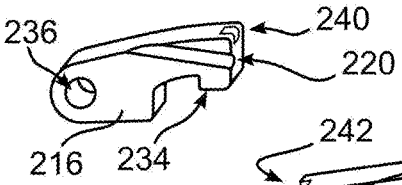
FIG. 25A
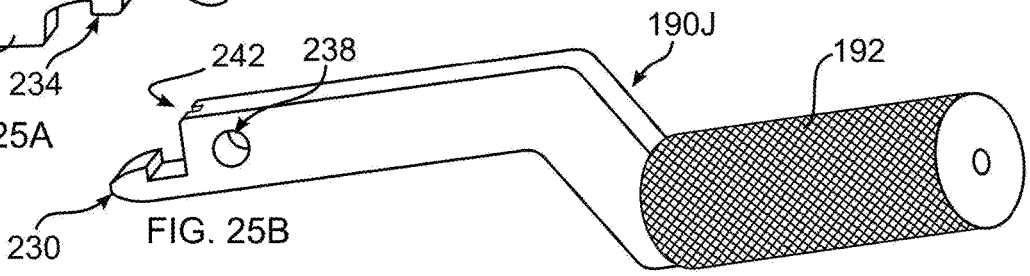
FIG. 25B

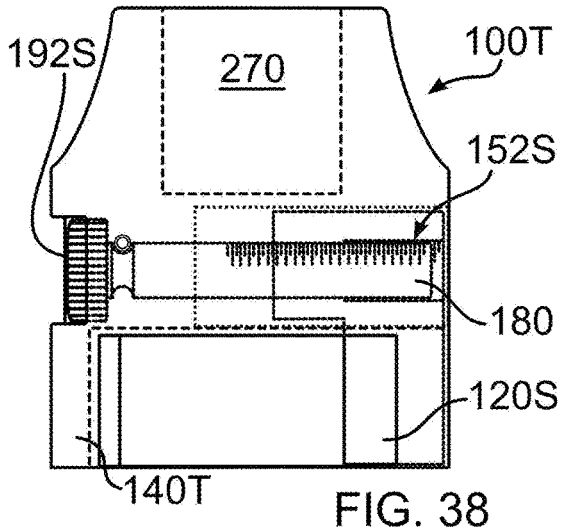
FIG. 38
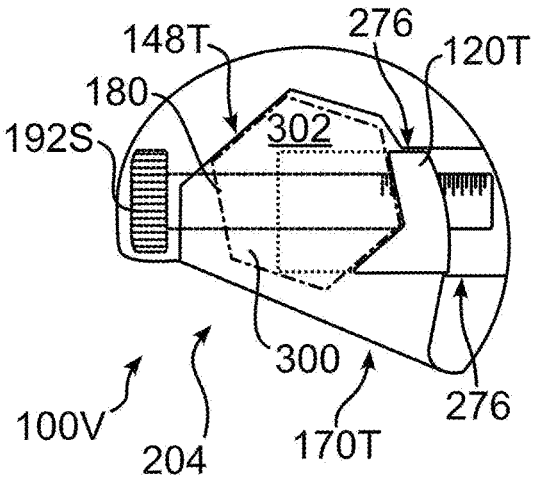
FIG. 39
FIG. 40
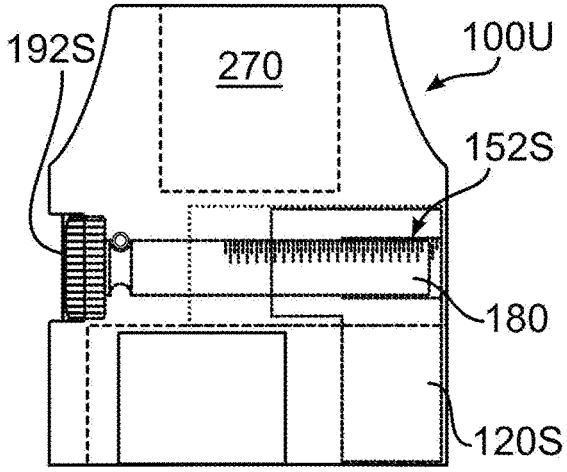
FIG. 41
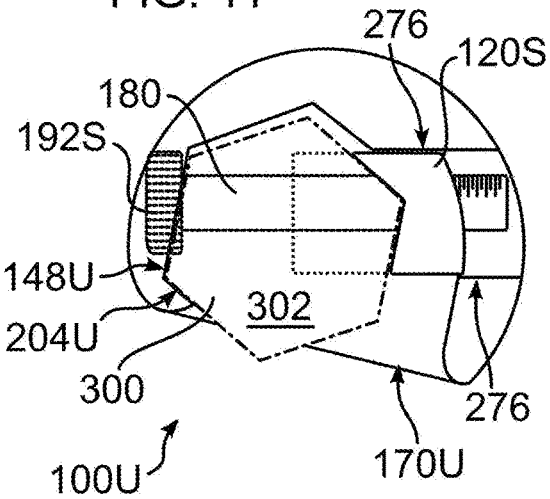
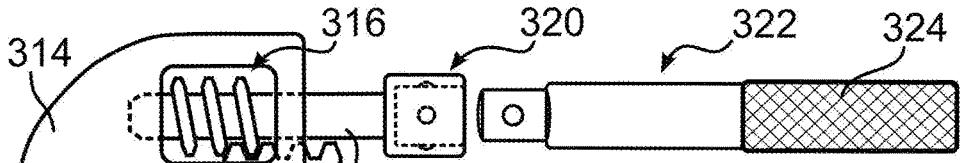
FIG. 42
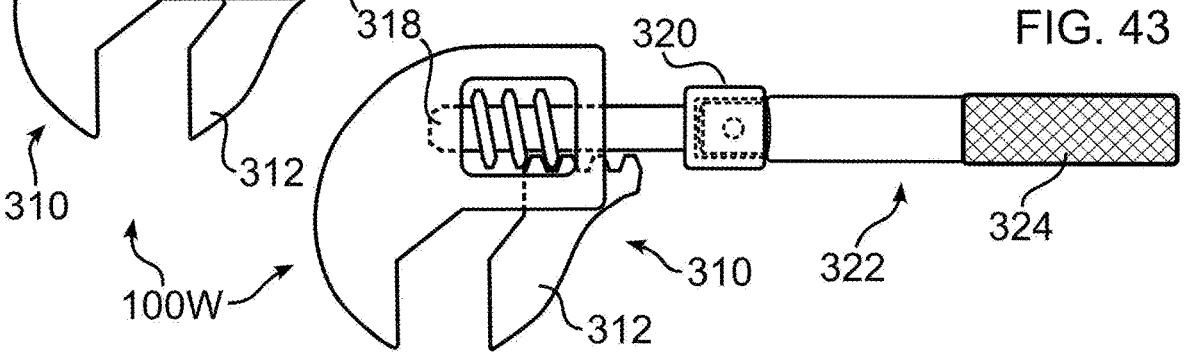
FIG. 43

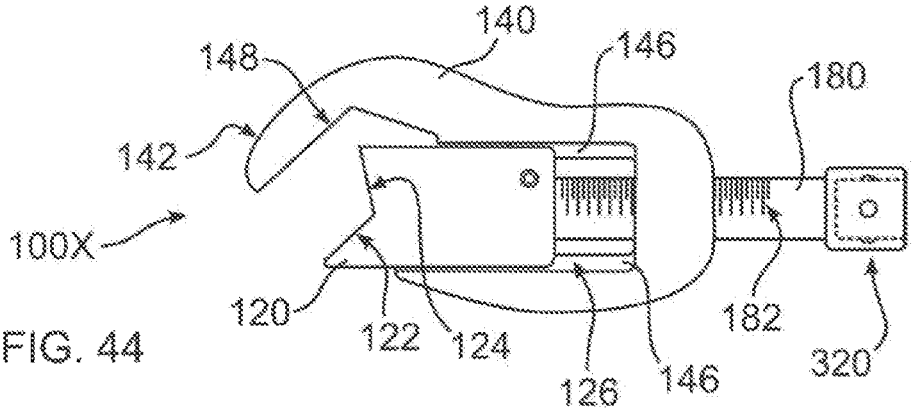
FIG. 44
FIG. 45
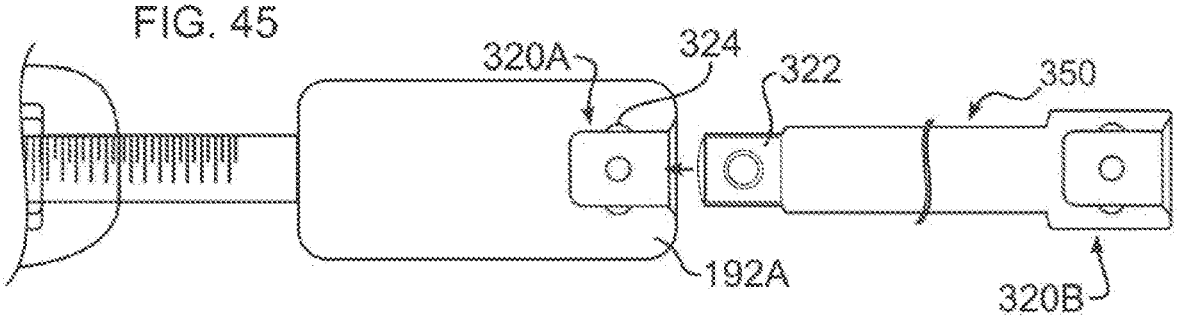
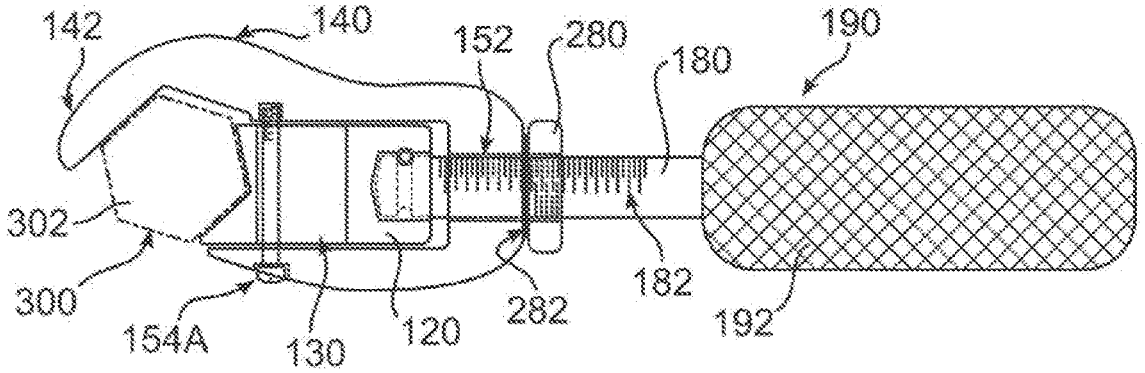
FIG. 46
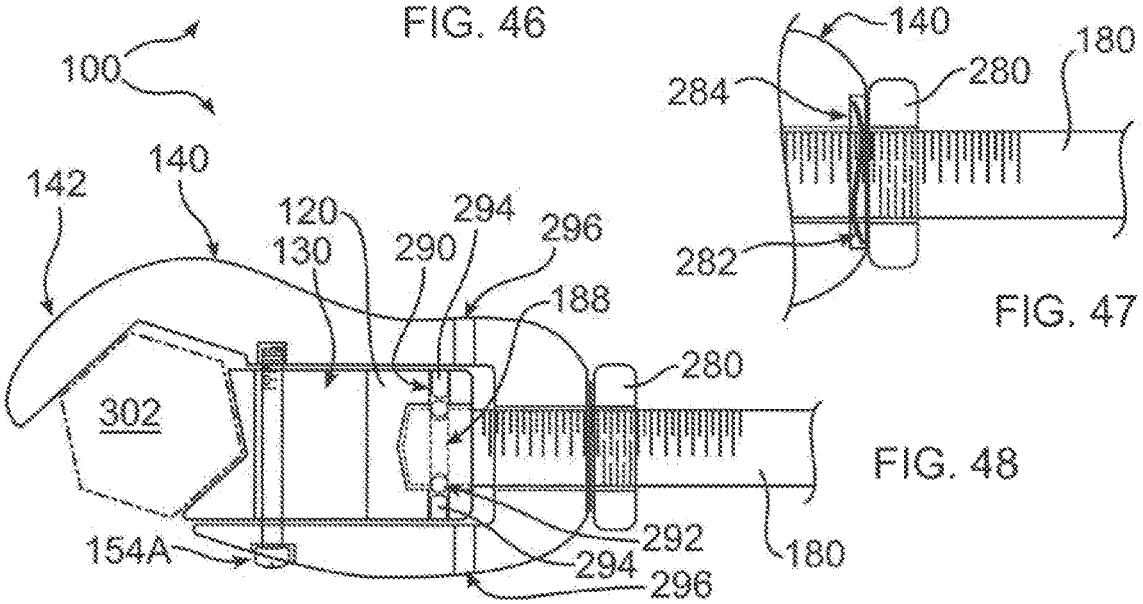
FIG. 47
FIG. 48

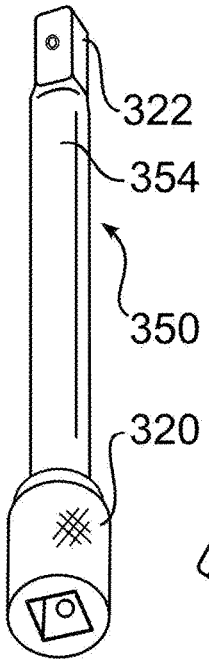
FIG. 49
PRIOR
ART
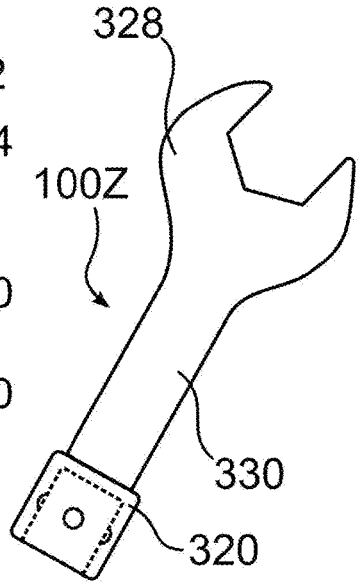
FIG. 50
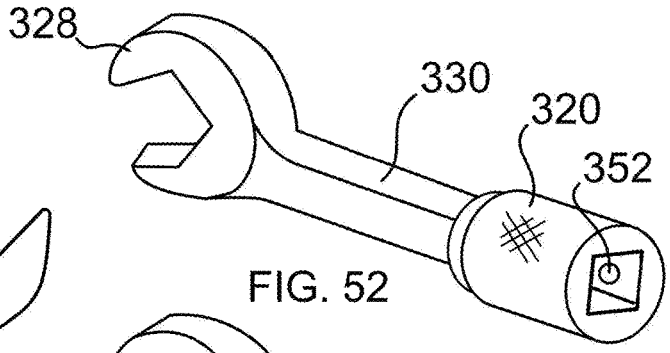
FIG. 52
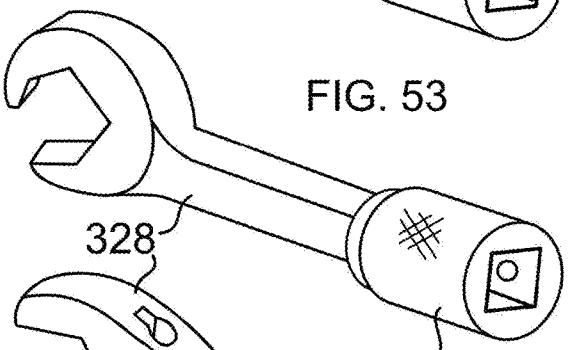
FIG. 53
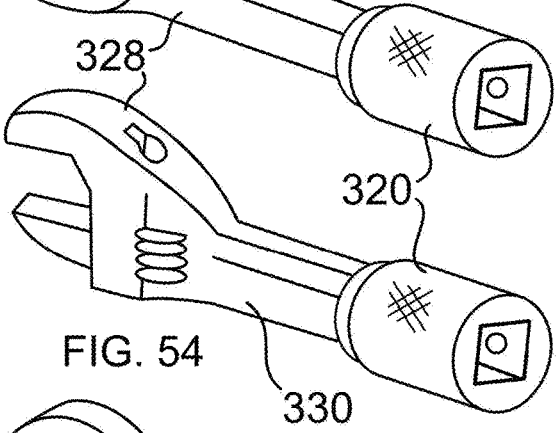
FIG. 54
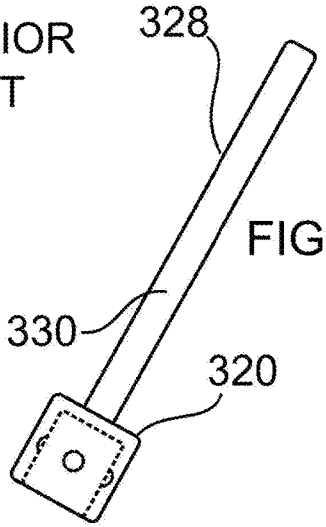
FIG. 51
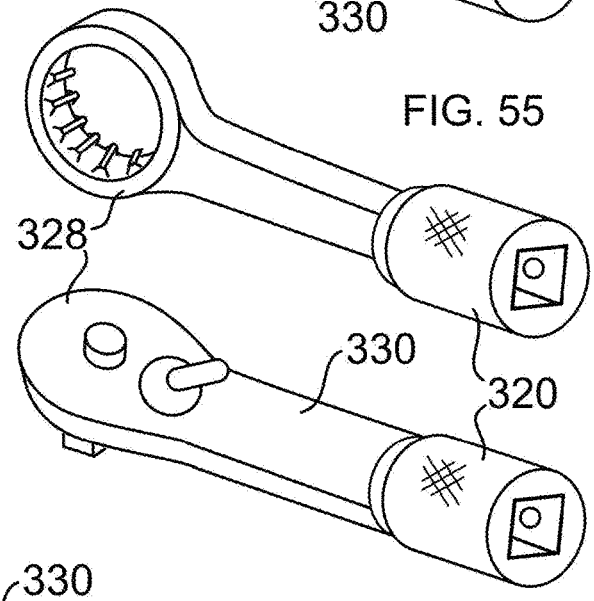
FIG. 55
FIG. 56
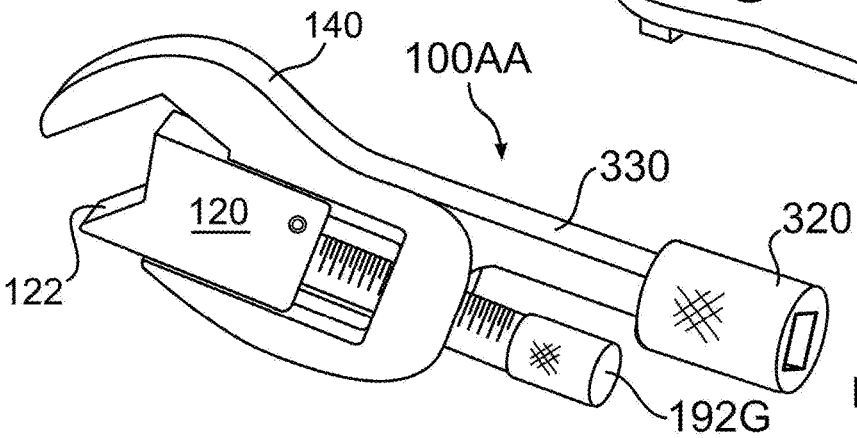
FIG. 57

ADJUSTABLE WRENCH

CROSS REFERENCE TO RELATED APPLICATIONS

This application claims the benefit of related U.S. patent application Ser. No. 15/149,227, filed May 9, 2016, and PCT Application No. PCT/US17/31508 filed May 8, 2017; the contents of each of which are incorporated herein by reference in their entirety.

FIELD OF THE DISCLOSURE

The disclosure relates to an adjustable wrench, and in particular to a wrench which engages at least three faces of a bolt or nut with pressure.

BACKGROUND OF THE DISCLOSURE

A wrench is a hand or machine operated tool to apply mechanical advantage to increase torque while rotating fasteners for tightening or loosening. A closed-ended wrench may be engaged with a nut or bolt when the wrench can be passed over an end of the nut or bolt. An open-ended wrench is used where the nut or bolt can only be accessed from a side approach. Adjustable wrenches include the monkey, pipe, or crescent wrench, as well self-adjusting wrenches.

SUMMARY OF THE DISCLOSURE

In an embodiment of the disclosure, a wrench connectable to a standard square shaped extension, comprises a wrench head including opposed jaw faces each having a planar surface portion, the jaw faces mutually defining a transverse plane connecting the jaw faces and lying perpendicular to each of the planar surface portions; and a standard square shaped extension socket affixed to the wrench head, the standard square shaped extension insertable into the standard extension socket along a direction that is non-orthogonal to the transverse plane.

In a variation thereof, the wrench further includes a frame including a fixed jaw forming one of the opposed jaw faces, the fixed jaw having a planar surface portion; a movable jaw forming the other of the opposed jaw faces, the movable jaw including at least one jaw face having a planar surface portion; the planar surface portion of the at least one movable jaw face remaining parallel to the planar surface portion of the fixed jaw face as the movable jaw is moved, the fixed and movable jaw faces mutually defining a transverse plane connecting the fixed and movable jaw faces and lying perpendicular to each of the planar surface portions; a guide connected to the frame and the movable jaw to control movement of the movable jaw along a line; and the standard square shaped extension socket affixed to one of the frame and the guide.

In another embodiment of the disclosure, a wrench connectable to a standard square shaped extension comprises a frame having a fixed jaw face having a planar surface portion; a movable jaw including at least one jaw face having a planar surface portion; the planar surface portion of the at least one movable jaw face remaining parallel to the planar surface portion of the fixed jaw face as the movable jaw is moved; and a guide connected to the frame and the movable jaw to control movement of the movable jaw along a line, the guide including: an elongate rotatable shaft, a portion of the shaft rotatable within a portion of the frame, a portion of the shaft including threads, the shaft rotatable to move the movable jaw; a standard extension socket connected to the frame, the socket forming a standard square extension socket of the type having a square inner profile engageable with a square outer profile at an end of the standard square shaped extension.

In variations thereof, the wrench further includes a widened portion at a free end of the shaft, the widened portion sized and dimensioned to be grasped by the hand of a user of the wrench, the standard extension socket positioned within a free end of the widened portion; the shaft is positioned at least one of alongside or in-line with the movable jaw; the frame, fixed jaw, and movable jaw forming the head portion of a standard monkey wrench; the shaft includes a free end, the portion of the shaft that is rotatable within the frame being an end opposite the free end; the shaft is threadably engaged with the frame; and/or the rotatable shaft is rotatable in a first direction to move the movable jaw away from the fixed jaw and to extend the shaft away from the frame to thereby increase an overall length of the wrench.

In further variations thereof, the at least one movable jaw face includes first and second jaw faces forming an angle of about 120 degrees relative to each other, each of the first and second jaw faces defining a planar surface portion along a longitudinal axis thereof; and the guide is connected to the frame and the movable jaw to control movement of the movable jaw along a line forming an angle of one of about 19.1 and about 40.9 degrees with respect to an intersection of the line and the planar portion of the fixed jaw face. In a variation thereof, the fixed, first, and second jaw faces defining a mutually intersecting plane, there being a part of the wrench lying upon the plane between the first jaw face and the fixed jaw face which is open to admit passage of the fastener along the plane, thereby forming an open end or flare style wrench.

In other variations thereof, the at least one movable jaw face includes first and second jaw faces forming an angle of about 120 degrees relative to each other, each of the first and second jaw faces defining a planar surface portion along a longitudinal axis thereof; and the guide is connected to the frame and the movable jaw to control movement of the movable jaw along a line forming an angle of about 40.9 degrees with respect to an intersection of the line and the planar portion of the fixed jaw face; the guide further includes a channel formed in at least one of the frame and movable jaw, and a projection formed upon the other of the frame and movable jaw, the projection and channel forming a mating slidable connection; the guide further includes a slot within the frame within which the movable jaw is slidably retained; an end of the shaft rotatably received within the movable jaw; the standard extension socket includes a detent dimensioned to receive a spring loaded ball of the standard square shaped extension when the extension is inserted within the socket; and/or the socket is sized to receive one of a ⅛, ¼, ⅜, ½, ¾, or 1 inch standard socket extension.

In another embodiment of the disclosure, a device for rotating a hex shaped fastener comprises a frame having a fixed jaw face defining a planar surface portion extending along a longitudinal axis thereof; a movable jaw including first and second jaw faces forming an angle of about 120 degrees relative to each other, each of the first and second jaw faces defining a planar surface portion along a longitudinal axis thereof; and a guide connected to the frame and the movable jaw to control movement of the movable jaw along a line forming an angle of one of about 19.1 and about 40.9 degrees with respect to an intersection of the line and the planar portion of the fixed jaw face, the guide including an elongate shaft including a first end engaged with the frame, and a second end at an end opposite the first end, the second end including a standard extension socket that includes a square shaped socket; the planar surface portion of the first jaw face remaining parallel to the planar surface portion of the fixed jaw face as the movable jaw is moved, the fixed, first, and second jaw faces defining a mutually intersecting plane, there being a part of the device lying upon the plane between the first jaw face and the fixed jaw face which is open to admit passage of the fastener along the plane.

In a variation thereof, the shaft is threadably engaged with the frame; and/or the rotatable shaft is rotatable in a first direction to move the movable jaw away from the fixed jaw and to extend the shaft away from the frame to thereby increase an overall length of the device.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein:

FIG. 1 depicts an open end wrench of the disclosure;

FIG. 2 depicts the wrench of FIG. 1, engaging a smaller bolt than in FIG. 1, and illustrating internal structures;

FIG. 3 depicts a wrench as in FIG. 1, with an elongated adjustment shaft;

FIG. 4 depicts an exploded view of the wrench of FIG. 1;

FIG. 5 depicts a cross section of the frame of FIG. 4, taken along line A-A;

FIG. 6 depicts a cross section of the movable jaw of FIG. 4, taken along line B-B;

FIG. 7 depicts the wrench of FIG. 1, including a frame brace structure;

FIG. 8 depicts a top view of the movable jaw of FIG. 7;

FIG. 9 depicts the wrench of FIG. 1, including an alternative frame brace structure;

FIG. 10 depicts the wrench of FIG. 1, including an extended frame which forms a handle;

FIG. 11 is a top view of the wrench of FIG. 10;

FIG. 12 is a perspective view of a wrench of FIG. 1, including a handle connected to the frame, the handle forming a rounded profile, including access to an adjusting grip within the handle;

FIG. 13 is a perspective view of an alternative handle and adjusting grip positioned at an end of the wrench;

FIG. 19 depicts an alternative wrench of the disclosure, including a handle connected to the frame at an offset angle, and a reduced size adjusting shaft;

FIG. 20 depicts the wrench of FIG. 20, in a two sided form, the second side sized smaller than the first;

FIG. 21A illustrates a geometric arrangement of the fixed and movable faces of wrenches of the disclosure;

FIG. 21B illustrates the geometric arrangement of FIG. 21, when a relatively smaller bolt is engaged FIG. 21C illustrates a relative alignment of the movable faces when engaging different size bolts;

FIG. 21D illustrates a mathematical relationship of fixed and movable faces of a wrench of the disclosure;

FIG. 22 depicts a 'ratcheting' or auto-releasing embodiment of a closed end wrench of the disclosure;

FIG. 23 is a top view of the wrench of FIG. 22;

FIG. 24 depicts the wrench of FIG. 22, in a releasing position, enabling repositioning of the wrench with respect to the bolt, while the wrench is engaged with the bolt;

FIG. 25A is a perspective view of a sliding latch portion of the wrench of FIG. 22;

FIG. 25B is a perspective view of a handle of the wrench of FIG. 22;

FIG. 38 depicts a socket of the type depicted in FIG. 30, with a slot removed for forming an open-end socket of the disclosure;

FIG. 39 is a bottom view of the socket of FIG. 38;

FIG. 40 depicts a socket of the type depicted in FIG. 30, with a slot removed for forming a flare style socket of the disclosure;

FIG. 41 is a bottom view of the socket of FIG. 40;

FIG. 42 depicts an alternative wrench of the disclosure, with a replaceable handle;

FIG. 43 depicts the wrench of FIG. 42, with a replaceable handle inserted into the wrench;

FIG. 44 depicts an embodiment of a wrench of the disclosure that is similar to that of FIG. 1, with the handle of FIG. 1 removed, and the shaft end configured to receive the handle of FIG. 42;

FIG. 45 depicts an embodiment of a wrench of the disclosure that is similar to that of FIG. 1, with the handle of FIG. 1 configured to receive the handle of FIG. 42;

FIG. 46 depicts an embodiment of a wrench of the disclosure, the adjustment shaft secured by a locknut;

FIG. 47 depicts an alternative locknut configuration of the disclosure;

FIG. 48 depicts an alternative attachment for the adjustment shaft;

FIG. 49 depicts a PRIOR ART standard socket extension;

FIG. 50 depicts a front view of a prior art wrench head and handle portion extending to form a prior art standard extension socket, to form a device of the disclosure;

FIG. 51 depicts a side view of the wrench and socket of FIG. 49;

FIG. 52 is a perspective view of a wrench in accordance with FIG. 49;

FIG. 53 is a perspective view of a wrench in accordance with FIG. 49, with a prior art flare wrench head;

FIG. 54 is a perspective view of a wrench in accordance with FIG. 49, with a prior art monkey wrench head;

FIG. 55 is a perspective view of a wrench in accordance with FIG. 49, with a prior art box end head;

FIG. 56 is a perspective view of a wrench in accordance with FIG. 49, with a prior art ratcheting socket head; and FIG. 57 is a perspective view of a wrench head of the disclosure extending to form a prior art standard extension socket.

DETAILED DESCRIPTION OF THE DISCLOSURE

Figure 14:
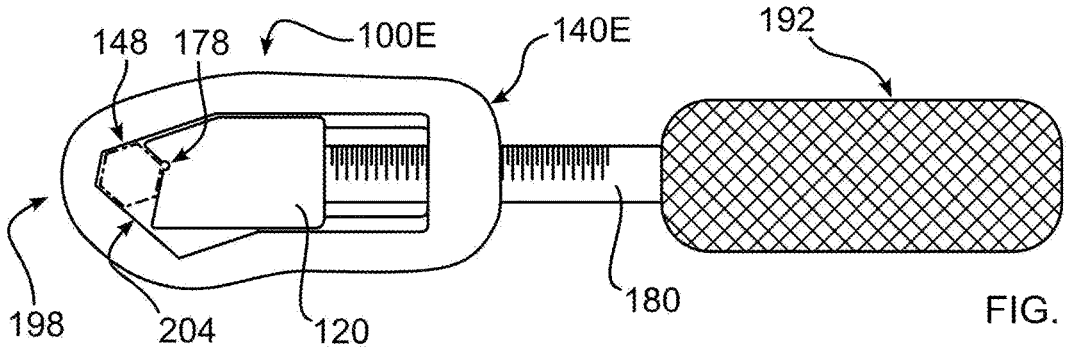
FIG. 14 depicts a closed end wrench of the disclosure.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

The disclosure relates to wrenches which grasp and turn the head of a nut, bolt, other fastener, or any other object graspable by the various embodiments herein, hereinafter simply fastener 300. The wrenches being referred to herein generally as 100, and in variations distinguished with a letter suffix. While the various embodiments are designated with a letter suffix for clarity, it should be understood that among the various embodiments, like numbers refer to like elements, and that the various embodiments of wrench 100 contain common features, as will be understood with reference to the drawings and the accompanying description.

With reference to FIG. 1, an open-ended embodiment of a wrench 100A of the disclosure grasps three flat sides and one corner of a hex sided nut, bolt, or fastener head 302, with pressure. More particularly, a corner and adjacent sides of head 302 are contacted by a movable jaw 120 which drives the head into contact with a fixed jaw 162, formed as an extension of frame 140. As can be seen in the exploded view of FIG. 4, frame 160 forms a U-shaped channel 144 sized to admit passage of movable jaw 120. A guide rail 146 extends along at least one side of U-shaped channel 144, and cooperates with at least one corresponding mating channel 126 to maintain movable jaw 120 within channel 144, and aligned with fixed jaw 120. As such, movable jaw 120 moves along a linear movement axis "A", as indicated by arrow "A" in FIG. 3.

Movable jaw 120 includes two faces 122, 124 forming an angle of about 120 degrees between them, when wrench 100A is configured for a hex head bolt, as illustrated. The term 'about' is used to indicate that manufacturing tolerances can produce variations in angle, and in consideration that variances of plus or minus a few degrees will still produce a working result, although a substantial deviation from 120 degrees will result in a less satisfactory device in terms of fit and performance. It should be understood that this angle will differ for a five or eight sided head, for example. In this embodiment, as movable jaw 120 slides within channel 144, face 122 maintains a parallel disposition with respect to face 148 of fixed jaw 142. To do so, an angular disposition of faces 122 and 124 with respect to axis "A" is defined by an angular disposition of face 148 with respect to such axis. In the embodiment shown, the angle is about 48 degrees, although this angle can be different. For example, a steeper angle which is more perpendicular to the movement axis, or a shallower angle can be used. Each has potential trade-offs in terms of the size and shape of frame 140, and the bending forces exerted upon frame 140, and thus a compromise or particular angle can be established for the intended purpose of the wrench, which is determinable by one skilled in the art.

As can be seen in the figures, movable jaw 120 and fixed jaw 142 maintain a contact along three sides of a six sided wrench when adjusted to grip a fastener head 302. A first 'flat' of the fastener head 302 (or any other object with engagement faces, such as a nut or plate) is engaged by face 148 of fixed jaw 142, and a second flat, directly opposite the first flat is engaged by face 122 of movable jaw 120. The third flat, adjacent to the second flat, is contacted by face 124 of movable jaw 120, and a shared corner of the fastener head 302 is engaged at an intersection of faces 122 and 124.

As can be seen in FIGS. 1-3, an entirety of the first flat is engaged by face 148, and all or substantially all of the second and third flats are engaged by faces 122 and 124, through a wide range of bolt sizes.

Movement of movable jaw 120 is carried out by an engagement between threads 182 of an adjusting shaft 180 and corresponding threads 150 of a bore 152 passing through frame 140. A distal end of shaft 180 passes into a bore 128 within movable jaw 120, and is rotatably secured by an engagement 184 of shaft 180 and movable jaw 120, which permits rotation of shaft 180 with respect to movable jaw 120. In this embodiment, engagement 184 includes a pin 186 passing through movable jaw 120, pin 186 slidably retained within a groove 188. It should be understood, however, that engagement 184 can be accomplished by any other known or hereinafter developed method, such as a press fit, or axial screw. In an embodiment, dimensional tolerances of pin 186, groove 188, and shaft 180 enable a leading end 194 of shaft 180 to bear upon an interior blind end of bore 128 of movable jaw 120, as shaft 180 is rotated and movable jaw 120 is tightened against nut or fastener 300. In this manner, tightening stress is not transferred to pin 186. The pitch of threads 182 can be selected to balance precision and accuracy for a fine pitch against, for example, considerations of manufacturing tolerance and speed of adjustment for a courser/steeper pitch.

Figure 17:
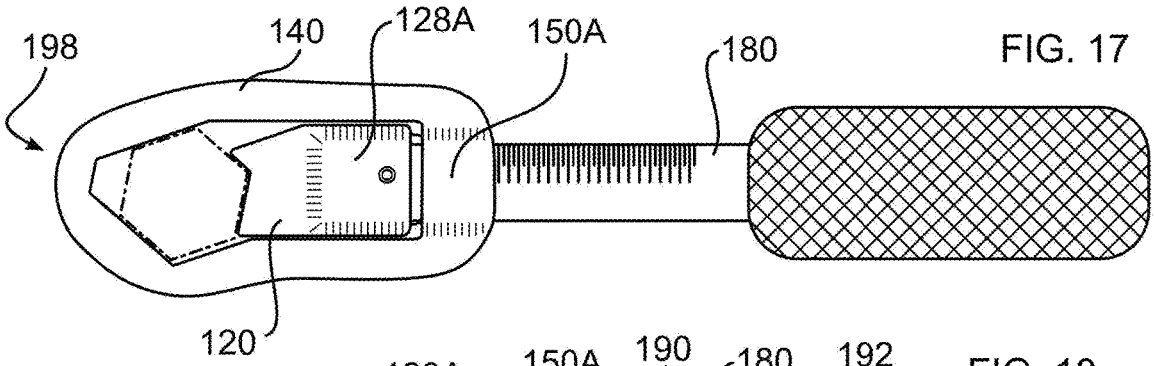
FIG. 17 depicts a reinforced, wider version of the wrench of FIG. 14.
Figure 18:
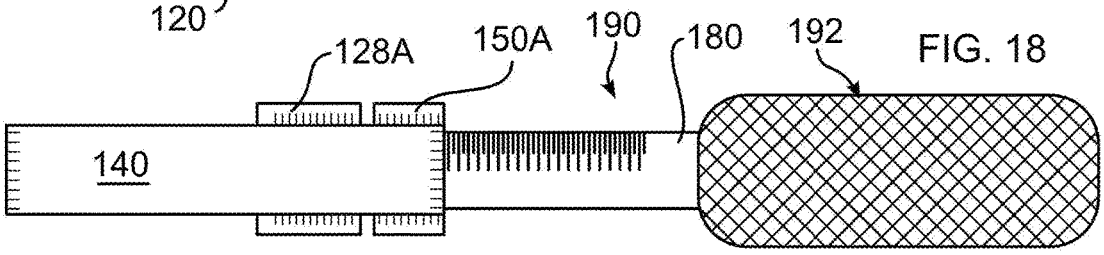
FIG. 18 depicts a top view of the wrench of FIG. 17.

In the embodiment of FIGS. 1-9 and 14-18, shaft 180 forms a lever or handle 190, and is provided with an enlarged end grip 192, in this embodiment grip 192 is knurled to improve a grip of a user's hand, although other styles of grip shapes can be employed, including padded or ergonomic shaped grips. In the embodiment of FIGS. 17-18, it can be seen that shaft 180A is enlarged, to provide greater strength for high torque applications. Accordingly, bore 152A of frame 140 is larger, and bore 128A of movable jaw 120 are correspondingly larger.

In an embodiment, grip 192 is affixed to shaft 180, whereby rotation of grip 192 causes a corresponding rotation of shaft 180, and a corresponding movement along axis "A".

In this manner, as handle 190 is moved radially with respect to a rotational axis of nut or fastener 300, grip 192 can be simultaneously rotated about axis "B" to maintain a firm and secure engagement with the nut or bolt head by maintaining pressure of an engagement of movable jaw 120 against the first, second, and third flats and the shared corner. Moreover, the tightening force exerted by rotation of the grip drives the distal end of shaft 180 directly and linearly towards fastener 300, in turn driving the nut or bolt head directly and linearly into fixed jaw 142, resulting in an efficient transfer of tightening energy. Accordingly, a smooth coordinated motion can both tighten or loosen a nut or bolt, while at the same time maintaining pressure on a grip of the fastener 300.

With reference to FIGS. 7 and 8, a frame bolt 154 passes through a first extending frame portion 156, then through a slot 130 within movable jaw 120, and then is threaded into a second extending frame portion 158 which is opposite the first extending portion 156. Bolt 154 includes a head or enlarged portion 154A, whereby when bolt 154 is threaded into the second extending portion 158, extending portions 156 and 158 are prevented from moving away from each other during the application of high amounts of torque during use of the wrench. This substantially reduces a potential distortion or spreading of frame 140, which could result in an imprecise grip of fastener head 302. Instead of a threaded connection to the second extending frame portion 158, bolt 154 or a pin can be inserted by a press fit, or can be attached between frame portions 156, 158 by any known manner. Slot 130 is shown in dashed lines in FIG. 7, and can be seen in FIG. 8, in an embodiment of movable jaw 120 as viewed from below.

In an alternative embodiment, shown in FIG. 9, a frame brace 162 can join first and second extending frame portions 156, 158, thereby eliminating a requirement of bolt 154 passing through movable jaw 120. Brace 162 can be formed together with a remainder of frame 140, or can be attached later by any known means, including for example welding, brazing, stamping, rivets, or threaded connection. Frame brace 162 can be placed on one or both sides of frame 140, but in either case, operates in a similar manner to bolt 154, with respect to preventing or reducing separation of extending frame portions 156, 158.

It should be understood that a configuration providing for bolt 154 or frame brace 162 is not needed in all applications, and that sufficient strength can be obtained by a choice of sufficiently strong materials and part thickness.

As can be seen in FIGS. 3-4 and 7-8, and particularly with reference to FIG. 4, guide rail 146A is shorter than guide rail 146. In this manner, there is sufficient space within frame 140 to insert movable jaw 120. More particularly, a lower mating channel 126, as viewed in FIG. 4, is engaged with guide 146 by inserting movable jaw 120 at an angle. Next, movable jaw 120 can be rotated about this connection to align an upper mating channel 126 with guide rail 146A, and then movable jaw 120 can be moved rearwards towards grip 192 to fully engage guide rails 146, 146A. In an embodiment, guide rail 146A is not used, and guide rail 146 and shaft 180 maintains movable jaw 120 in position throughout a range of motion of movable jaw 120. In another embodiment, frame bolt 154, and/or frame brace 162 provides further stabilization, together with frame guide 146. Finally, neither guide rail is used, and stabilization throughout the range of motion is provided by shaft 180 and frame bolt 154 and/or brace 162.

With respect to installing movable jaw 120 within frame 140, it should be understood that movable jaw can be installed prior to, or during formation of frame 140, and therefore guide rail 146A can be longer than illustrated. Additionally, brace elements can have a shape or location which would not be possible in a configuration where movable jaw 120 must be installed after formation of frame 140.

In the embodiment of FIGS. 10-12, handle 190A of wrench 100B is formed from an extension of frame 140 forming a frame perimeter 164 which extends around shaft 180 and grip 192, thereby serving to bear some or all of the bending force imparted by applying torque to the wrench to tighten or fastener 300. In this manner, shaft 180 can have a smaller diameter, or can be made with lighter materials, or can generally be weaker than if it forms a load bearing part of handle 190. Grip 192 can also be smaller, but is advantageously wider than handle 190A so that it may be easily manipulated and rotated to adjust a position of movable jaw 120. In FIG. 10, it may be seen that a screw or pin 164 is connected to frame 190A and rotatably supports grip 192. Although pin 164 adds further strength and support to shaft 180 and grip 192, it is not a requirement for proper operation of wrench 100A.

In FIG. 12, frame perimeter 164C of wrench 100C functions in a similar manner to frame perimeter 164 of FIGS. 10-11, however frame perimeter 164A forms a portion of a cylinder or other more ergonomic shape relative to the hand. Portions of the cylinder are removed to expose grip 192C, which is enlarge relative to grip 192, so that grip 192C can be rotated to adjust movable jaw 120 as described herein. In this embodiment, torque can be applied to both frame perimeter 164C and grip 192C.

In FIG. 13, wrench 100D includes an enlarged grip portion 192D1 that is fixed to frame 140 to not move with respect to frame 140. In this manner, grip 192D1 provides a sturdy, ergonomic, non-rotating grip for applying large amounts of torque to wrench 100D. In addition, a second grip portion 192D2 is connected to shaft 180 to rotate shaft 180 to adjust movable jaw 120 as described herein. A size and shape of grip portion 192D2 can be coordinated with grip portion 192D2, so that they can be gripped together by a single hand comfortably. For example, they can each form part of a single handgrip profile, such as a palm shaped profile.

FIG. 13A illustrates one possible way for grip portions 192D1 and 192D2 to be connected to transfer tightening and loosening torque from grip 192D2 to 192D1, and ultimately to frame 140, in this example a rotating dove-tail connection 196. It can be seen that shaft 180 does not contact grip portion 192D1, and is affixed to, or is unitary with, grip portion 192D2. In the embodiment of FIG. 13A, shaft 180 engages threads within movable jaw 120 to move jaw 120 along longitudinal axis "A", and whereby shaft 180 does not move longitudinally along the length of wrench 100D. In an alternative embodiment, grip portion 192D2 moves longitudinally in connection with shaft 180, and thereby separates and moves away from grip portion 192D1.

Referring now to FIG. 14, frame 140E forms a box wrench having a closed end 198, which can result in a frame which is stronger than an open end, and which therefore has less of a requirement for frame bolt 154 or frame brace 162 in high stress applications. However, these elements can be combined with frame 140E if desired. It should further be understood that a closed head configuration such as frame 140E can be used with any other embodiment of the disclosure, and further that throughout this application, aspects of the various embodiments can be exchanged to form a wrench which has the desired attributes of each aspect.

Figure 15:
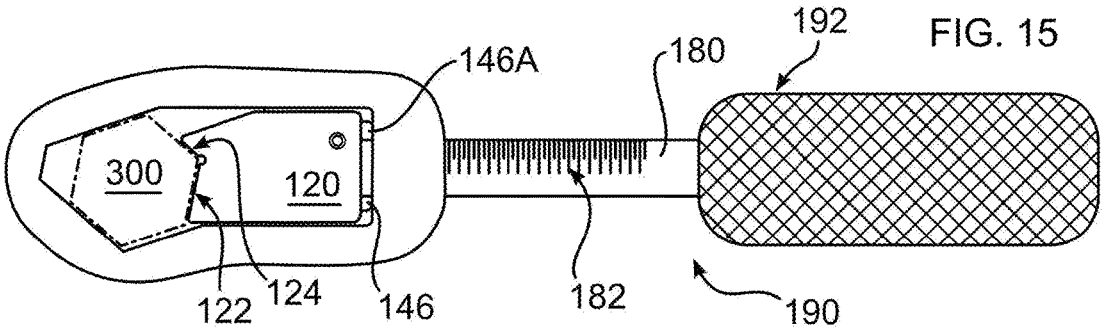
FIG. 15 depicts the wrench of FIG. 14, engaging a larger bolt.

FIG. 15 illustrates wrench 100E with a larger fastener 300 relative to FIG. 14. As can be seen comparing FIGS. 14 and 15, wrench 100E forms a longer handle when a larger bolt is engaged, due to shaft 180 threadably backing away from frame 140E. This provides a user with progressively greater leverage as larger bolts are tightened or loosened, when greater leverage is typically needed or desired.

Figure 16:
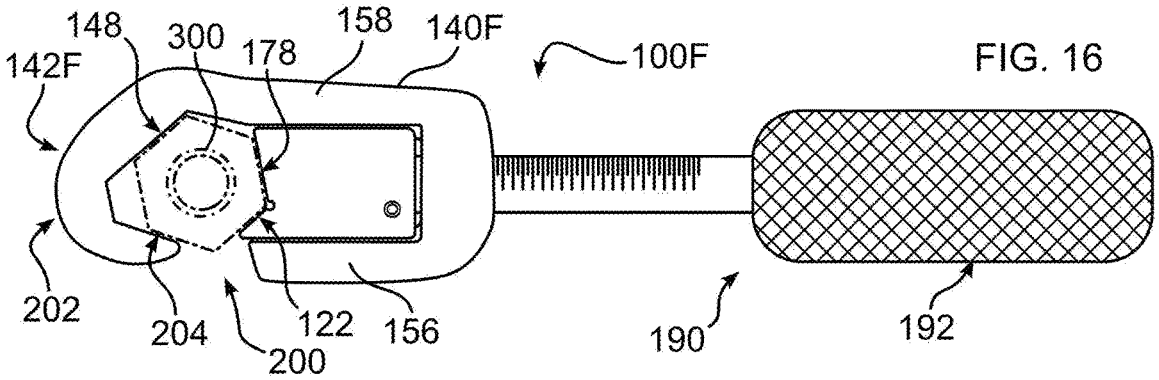
FIG. 16 depicts a partially closed end wrench of the disclosure.

FIG. 16 illustrates an alternative partially closed wrench head shape in the form of flare nut driver frame 140F, which includes an opening 200, and a hooked frame end 202. In this embodiment, movable jaw engages two flats of bolt head 302 as described with respect to other embodiments herein, and urges bolt head 302 against frame end 202 which engages the bolt head 302 upon an additional two bolt head 302 flats, against frame 140F faces 148 and 204 of fixed jaw 142F. FIGS. 17-18 illustrate the wrench of FIG. 15, however have a larger shaft 180, bore 152A, and frame 140, to better withstand bending forces applied to handle 190.

FIG. 16 shows a nut being engaged, to illustrated that either a nut or a bolt type fastener 300 can be similarly engaged with any of the embodiments herein. A notch 178 at a junction of faces 122 and 124 of movable jaw 120 is illustrated in FIGS. 14-16, and can be provided with any movable jaw 120 of the disclosure. Notch 178 enables a wedging action of faces 122 and 124, and additionally prevents a corner of bolt head 302 from landing against movable jaw 120, which could stop advancement of faces 122 and 124 into wedged contact with mating faces of bolt head 302.

In FIG. 19, frame 140G functions as described with respect to frame 140F, with the following distinctions. Particularly, shaft 180 has been reduced in size, and grip 192 has been reduced in size to form an adjusting knob 192G which can be rotated to adjust movable jaw 120. Knob 190G is not intended to be pushed or pulled to rotate wrench 100G about a fastener; instead, handle 190G attaches to and extends away from frame 140G and does not include either shaft 180 or grip 192. Handle 190G can have any known or hereinafter developed configuration for a wrench handle, which is sufficiently strong, and is advantageously ergonomic. A particular angular disposition of handle 190G can be dependent upon an angular disposition of shaft 180. In the embodiments shown, and as described elsewhere herein, shaft 180 has a particular longitudinal axis which relates to an optimal path for movable jaw 120 with respect to faces 148, 204 of fixed jaw 142, for a maximum range of bolt head 302 sizes which can be engaged by wrench 100. However, other angular dispositions of these elements may be selected which may yield a more limited range of bolt sizes, but which provide other advantages, such as a reduced size of frame 140, greater strength, an alternative geometry/outer shape of frame 140, or an alternative angle between bolt head 302 and handle 190G, as examples. Additionally, an angular orientation of shaft 180 can be selected which enables a different placement of handle 190G than as shown.

FIG. 20 illustrates an alternative embodiment of the wrench 100 of FIG. 19, in which a frame 140G and associated components is placed at each end of handle 190H. In an embodiment, each of frames 140G is a different size, and is therefore configured to engage a different range of bolt head 302 sizes. It should be understood that any frame 140 and associated parts which collectively form a wrench 100 head of the disclosure can be joined together in a common handle 190H in the manner shown in FIG. 20, to form a combination wrench.

In the closed and partially closed end configurations of wrench 100, the two faces 122, 124 of movable jaw 120 are positioned on an opposite side of bolt 300 with respect to engagement of faces 148, 204. In all embodiments, including open ended wrenches 100 such as are shown in FIGS. 1-11, bolt head 302 is wedged against at least one fixed face.

More particularly, as can be seen in FIGS. 14-25 and 30-36, and with further reference to FIG. 21A-D, bolt head 302 is driven into a progressively narrowing space 166, thereby applying a pinching or wedging effect upon bolt head 302, reducing a likelihood of relative rotation between wrench 100 and bolt head 302 during tightening or loosing, resulting in a reduced possibility of stripping head 302. In order for movable jaw 120 to drive the widest range of bolt head 302 sizes directly into this narrowing space, while maintaining engagement between faces 148 and 204 of the fixed jaw (or only face 148 of an open end style wrench), and faces 122 and 124 of the movable jaw 120, movable jaw moves along a path "A" which is at a defined angle θ with respect to a planar intersection of faces 148 and 204, which is 19.1 degrees.

Thus, movable jaw is guided by shaft 180 and/or guide rails 146, or is otherwise guided to follow a path along line "A" that lies at an angle of about 19 degrees with respect to a plane formed by either fixed face 148 or 204. Thus, if the 19 degree angle is formed between fixed face 148 and line "A", movable jaw face 124 will lie at an angle of 120 degrees relative to adjacent fixed face 148. Likewise, if the 19 degree angle is formed between fixed face 204 and line "A", movable jaw face 124 will lie at an angle of 120 degrees relative to adjacent fixed face 204. Line "A" additionally intersects a corner formed by faces 122 and 124 of movable jaw 120.

A model of movement of movable jaw 120 with respect to faces 148 and 204 is illustrated in FIGS. 21A-21D, in which FIGS. 21A-21B illustrate a predetermined desired range of bolt head sizes. Movable jaw 120 engages two adjacent faces of bolt head 302, and fixed faces 148 and 204 engage two opposite faces of bolt head 302. Faces 148 and 204 form an angle of about 60 degrees between them, corresponding to the 120 degree internal angles formed by bolt head 302 faces.

It is desired that fixed jaw 142 and movable jaw 120 'land' against and fully engage with pressure against the faces of bolt 300, subjecting bolt head 302 to a pinching or wedging force. The wedging force is exerted along the entire surface of the contacted faces of bolt head 302 with continuously increasing pressure, as pressure applied by movable jaw 120 is increased, and as the wrench is rotated to tighten bolt 300.

It should be understood that forming an angle between line "A" and either of the fixed jaw faces 148, 204 need not be exactly 19.1 degrees for wrench 100 to function. As a practical matter, to control costs, parts of wrench may be fabricated using manufacturing methods which may not produce movement along an angle of exactly 19.1 degrees, particularly in light of tolerance stackup amount several parts. Provided there is an ability for movable jaw 120 to wobble or displace along its guide path, it may still be possible to fully engage bolt 300 if the angle is merely about 19 degrees, for example it may be varied to any extent plus or minus up to 6 or more degrees, for example by several tenths or several degrees, but the range of bolt 300 sizes that can be accommodated may be reduced, as well as the reliability and strength of wrench 100, as the deviation from an angle of 19.1 degrees increases.

Likewise, the 60 degree angle formed between fixed faces 148 and 204 can vary, as can the 120 degree angle formed between the faces 122, 124 of movable jaw 120. An angle of about 60 degrees or about 120 degrees, respectively, may be sufficient. For example these 60 and 120 degree angles could be increased or decreased to any extent up to 6 or more degrees, for example several tenths or several degrees, but with progressively diminished wrench performance as the angle deviates.

As shown in FIG. 21B, a size of movable jaw 120 is maximized in accordance with its position when the smallest bolt head 302 is engaged. In this manner, the largest possible contact area of faces 122 and 124 are realized when engaging the largest bolt head 302. The smallest and largest bolt head 302 sizes are therefore predetermined in accordance with considerations of a desired maximum frame 140 size, and minimum sizes for faces 122 and 124, as well as other considerations, such as weight, overall size, cost, precision, and strength, for example.

Because wrench 100 does not engage opposite points of bolt head 302, movement of movable jaw 120 along line "A" is not aligned through opposed points of bolt head 302. The geometry of an optimized wrench of the disclosure is illustrated in FIG. 21D. A right triangle 176, shown with long dashes, is formed by the intersection of fixed faces 204 and 148, a bolt 302 face, and an opposed point of bolt head 302. FIG. 21D is flipped vertically with respect to FIGS. 21A-21D, and other illustrations, to orient triangle 176 for ease of understanding. It should be understood, however, that the orientation of FIG. 21D could be employed in any of the embodiments herein, resulting in a changed orientation of frame 160 and handle 190, but a like manner of operation and use.

For open ended wrenches, such as are shown in FIGS. 1-3, for example, the angle formed between fixed face 148 and arrow "A" is the complement of the 19.1 degree angle, or 60 degrees minus 19.1 degrees, or 40.9 degrees, as face 204 is not provided.

The angular orientation of jaw movement along line "A" with respect to faces 148 and 204 is governed by angle θ, which can be derived as follows. If a length of a face of bolt head 302 is taken to be x, then an adjacent side of triangle 176 is formed by an equilateral triangle having all sides equal to x, a side of bolt head 302 which is equal to x, and a side of a 30-60-90 degree right triangle. It is known that the relationship of the sides of a 30-60-90 right triangle are 1:sqrt(3):2, which gives us a length of 0.5x for the last portion of the adjacent leg of triangle 176. Once we have the adjacent and opposite lengths of triangle 176, we can calculate θ as:

$$\tan(\theta)=0.866/2.5, \text{ or } \theta=\tan^{-1}(0.3464)=19.1 \text{ degrees.}$$

Alternatively, we can calculate the hypotenuse using the Pythagorean theorem and calculate θ as:

$$\sin(\theta)=0.866/2.64574, \text{ or } \theta=\sin^{-1}(0.3273)=19.1 \text{ degrees.}$$

The particular engagement of bolt head 302 described above enables an open ended wrench, as compared with engaging opposing corners of bolt head 302, in that an open ended wrench of the disclosure is practical and secure, and is particularly so with large bolts (e.g. as illustrated in FIG. 3), where bending forces are greatest. Corner engaging wrenches of the prior art, which engage opposing corners of a bolt head, are not practical as open ended wrenches, as the bolt head, regardless of size, is always positioned at the very tip of the wrench, where it can easily be twisted out, particularly for large size bolts. Wrenches which perpendicularly engage a flat of a bolt head, cannot form an open ended wrench. Additionally, such prior art wrenches, as well as monkey/pipe wrenches of the prior art, do not provide the wedging action of the disclosure as shown and described herein. Wedging is superior to a mating landing face, because variations due to manufacturing tolerances can be taken up by small displacements in bolt head 302 within the wedge, until a maximal contact surface is obtained. Likewise, as opposed to a monkey wrench, in which the nut or bolt can move horizontally within the jaw, there is no such movement in a wrench 100 of the disclosure. Further, as the nut or bolt is moved as far forward as possible to an end of the wrench, a required clearance forward of the nut or bolt is minimized.

FIG. 22-25 illustrate a closed end 'ratcheting' or auto-releasing wrench 100J of the disclosure, in which rotation of wrench 100J in a first direction engages and rotates fastener 300, and rotation of wrench 100J in a second opposite direction enables rotation of wrench 100J with respect to fastener 300. Accordingly, a fastener 300 can be tightened without lifting wrench 100J off of fastener 300, and movement of wrench 100J to tighten or loosen fastener 300 can be carried out solely by movement of wrench 100J along a plane.

More particularly, frame 140J includes a closed end 198J including closed ended jaw 148J which is connected to a U-shaped base portion 210 of frame 140J at pivot 212. A movable pivot 214 connects closed ended jaw 148J, at an opposite end with respect to pivot 212, to a sliding latch portion 216. Movement of sliding latch portion 216 is confined to a path defined by a rail 218 extending from U-shaped base portion 210 which mates with a corresponding channel 220 within sliding latch portion 216. Channel 220 can be formed on opposite sides of sliding latch portion 216, and rail 218 can be formed on both inner sides of base portion 210, which forms a channel within which sliding latch portion 216 moves. As with other rail/channel engagements herein, it should be understood that the relative locations of the rail and channel can be reversed; in this instance, for example, rail 218 can be formed in sliding latch portion 216 and channel 220 can be formed in base portion 210.

A spring 224 connects sliding latch portion 216 and handle 190J, urging sliding latch portion 216 into mating engagement with pivotable latch portion 232 which extends from handle 190J. Spring 224 can alternatively be connected between sliding latch portion 216 and U-shaped base portion 210. While spring 224 is illustrated as a tension spring, it should be understood that sliding latch portion 216 can be biased into mating engagement with pivotable latch portion 232 by other spring types as would be understood within the art. For example, a torsion or clock spring can be associated with pivot 212.

Sliding latch portion 216 includes a catch 230, and pivotable latch portion 226 includes a hook 234 which matingly engage when sliding latch portion 216 and pivotable latch portion are in mating contact. To disengage catch 230 and hook 234, handle 190J is pushed in an upwards direction as viewed in the figures, to rotate handle 190J counter-clockwise about handle pivot 226. A torsion or clock spring 228 can be connected to base portion 210 and handle 190J to bias handle 190J to rotate clockwise to engage catch 230 and hook 234. A ledge 254 is formed within U-shaped frame portion 210 braces handle 190J and forms a limit to clockwise rotation of handle 190J with respect to frame 140P. Ledge 254 cooperates with pivot 228 when tightening fastener 300 to brace handle 190J when applying torque to frame 140P. A stop 256 formed as a protrusion upon frame 140J limits rotation of handle 190J with respect to frame 140J during release of fastener 300. For the embodiment of FIGS. 22-25, either one of face 148 or 204 can be positioned adjacent to sliding latch portion 216.

To use wrench 190J to tighten a fastener 300, bolt head 302 is positioned within frame 140J and is contacted by frame faces 148, 204 and movable jaw faces 122, 124, as described elsewhere herein. End grip 192 is grasped by a hand of the user and wrench 100J is rotated clockwise along the plane of the page, as viewed in the figures, to move wrench 100J through a tightening stroke. Due to engagement of catch 230 and hook 234, sliding latch portion 216 is unable to move, and wrench 100J functions in the manner of fixed wrench 140E of FIGS. 14-15, for example.

With reference to FIG. 24, At the end of a stroke, it may be desired to further turn or tighten fastener 300. Accordingly, wrench 100J is moved in an opposite, or counter-clockwise direction as viewed in the figures. This movement disengages hook 234 from catch 230, and wrench 100J is rotated with respect to bolt head 302. More particularly, the corners of bolt head 302 push against closed ended jaw 148J, which is displaceable due to the disengagement of sliding latch portion 216 and pivotable latch portion 226. Closed ended jaw 148J pivots about pivot 212, which causes pivot 214 to be displaced along the plane of the page as viewed, which also causes displacement of sliding latch portion 216 along rail 218. This causes an enlargement of the enclosed portion of frame 140J, which enables rotation of fastener 300 within frame 140J.

When the relative rotation of wrench 100J and fastener 300 is sufficient to realign faces of bolt head 302 with frame faces 148, 204 and movable jaw faces 122, 124, bolt faces no longer push against close ended jaw 148J. As such, an interior dimension of the enclosed portion of frame 140J can once again be reduced in size as spring 224 pulls sliding latch portion 216 back into latched engagement with pivotable latch portion 232. Once reengaged, frame handle 190J can once again be rotated in a clockwise direction to continue turning or tightening fastener 300 as described above.

With reference to FIGS. 25A-25B, sliding latch portion 216 and pivotable latch portion 232 are shown in perspective, including respective pivot apertures 236, 238. A pin, not shown, passes through corresponding apertures in movable pivot 214 and handle 190J, although pivots 212, 214, and 226 can be formed by any known means. Notches 240, 242 can be formed in sliding latch portion 216 and pivotable latch portion 232, respectively, to form a space for spring 224.

Figure 26:
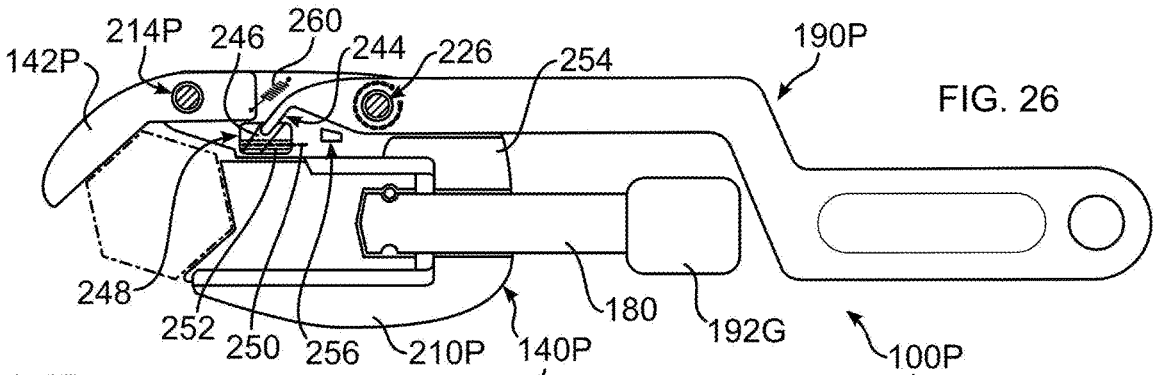
FIG. 26 depicts a 'ratcheting' or auto-releasing open ended wrench of the disclosure.
Figure 27:
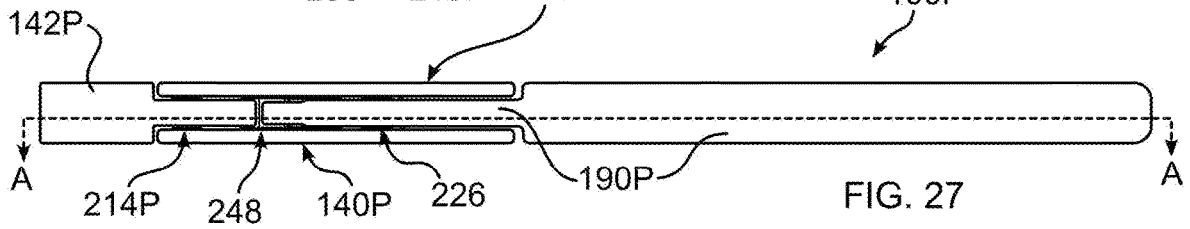
FIG. 27 is a top view of the wrench of FIG. 26.
Figure 28:
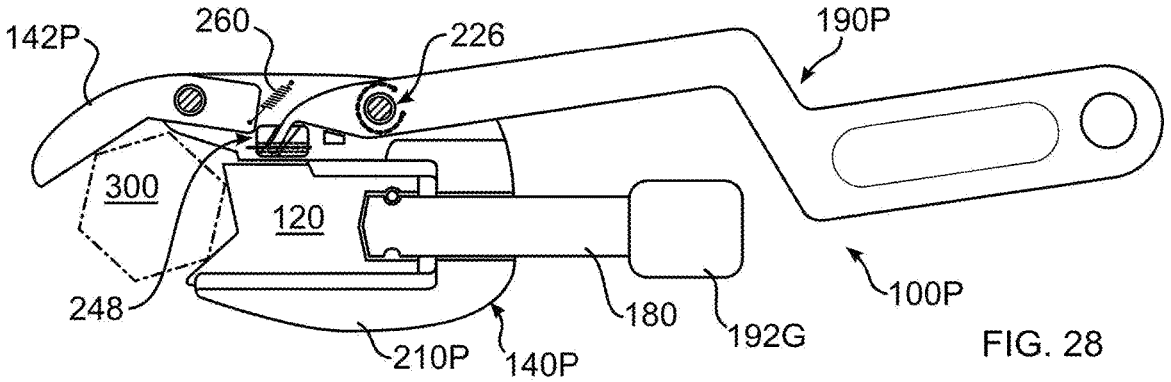
FIG. 28 is a cross sectional view of the wrench of FIG. 27, taken along line A-A of FIG. 27.
Figure 29:
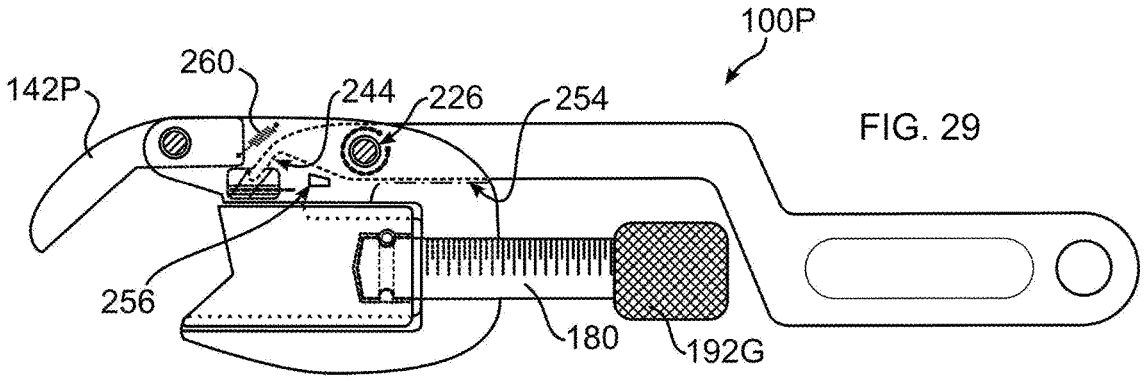
FIG. 29 depicts the wrench of FIG. 26, showing hidden lines.

Referring now to FIGS. FIG. 26-29, an open end 'ratcheting' or auto-releasing wrench 100P of the disclosure is illustrated, in which rotation of wrench 100P in a first direction engages and rotates fastener 300, and rotation of wrench 100P in a second opposite direction enables rotation of wrench 100P with respect to fastener 300. FIGS. 26 and 28 are shown in a cross-section taken through line A-A of FIG. 27, and FIG. 29 is a hidden line view of the wrench of FIG. 26.

Frame 140P pivotally supports handle 190P at pivot 226, as described with respect to FIG. 21; however, hook 234 is replaced with a cam 244 extending away from pivot 226. A ramped cam follower channel 246 within a surface of locking block 248. As handle 190P is moved, cam 244 slides along follower channel 246 to move locking block 248 closer or farther from pivot 226. Movement of locking block 248 is constrained by mating rails 250 extending inward from frame portion 210P, which travel within guide channels 252 formed within locking block 248. Alternatively, as with other rail/channel sliding engagements herein, locking block 248 can include a protruding rail which engages a channel in frame portion 210P. When handle 190P is rotated about pivot 226 clockwise as viewed in FIG. 26, it will eventually rest upon ledge 254. In this position, cam 244 has pushed locking block under pivoting fixed jaw 142P, thereby preventing pivoting fixed jaw 142P from rotating about pivot 214P. In this configuration, wrench 100P functions in a manner as described with respect to the wrench of FIG. 1 when tightening.

When handle 190P is moved counter-clockwise about pivot 226, as viewed in FIG. 26, cam 244 slides within cam follower channel 246 to move locking block 248 closer to pivot 226 and out from under pivoting fixed jaw 142P. When block 248 has been moved in this manner, pivoting fixed jaw 142P becomes free to rotate about pivot 214P. In this configuration, when wrench 100P is rotated with respect to fastener 300, the corners of bolt head 302 push against pivoting fixed jaw 142P, moving face 148 away from movable jaw 120, enabling rotation of fastener 300 with respect wrench 100P. As with wrench 100J of FIG. 21, further rotation of wrench 100P will realign the bolt head 302 faces with face 148 and movable jaw faces 122 and 124. Spring 258 biases pivoting fixed jaw 142P into engagement with fastener 300, and positions pivoting fixed jaw 142P to enable locking block 248 to be moved under pivoting fixed jaw 142P by cam 244, whereby tightening can be carried out by further clockwise movement of handle 190.

A biasing element 260 of any type, in this example a spring, connects between frame 140P or handle 190P and fixed jaw 142P, to urge fixed jaw 142P to rotate about pivot 214P, clearing a space under of fixed jaw 142P so that block 252 can slide under fixed jaw 142P. When it is desired to locked fixed jaw 142P, handle 190P is pulled back to contact ledge 254, while causing block 248 to slide under lock jaw 142P, thereby locking jaw 142P in position for a subsequent tightening or loosening operation.

Wrenches 100J and 100P can be flipped over vertically, as viewed in the Figures, and reengaged with a fastener 300, whereby fastener 300 can be tightened or loosened in an opposite rotational direction. As in FIG. 22, a stop 256 limits rotation of handle 190P when releasing fastener 300, and ledge 254 limits rotation when tightening or loosening. While releasing wrench 100J and 100P enable movement of one or both of fixed faces 142, 204, they are still fixed in the sense that when they are retained in a tightening orientation, they remain fixed with respect to movement of movable jaw faces 122, 124.

With reference to FIGS. 30-36, a socket 100S is usable with a standard socket driver handle or ratchet driver, for example a one-fourth, three eighths, or half-inch socket driver, of any style. A tool engagement 270 is configured to engage with the standard driver, and includes mating parts as understood within the art, including for example a detent engagable with a spring biased locking bearing of the driver. Alternatively, shaft 180 can be extended to form a handle 190 as described herein, or a handle 190 (not shown) can be affixed to socket 100S in any manner, for example to form a Saltus wrench. Similarly, a releasing mechanism as described in FIG. 22-25 or 26-29 can be adapted to socket 100S.

Socket 400 includes analogous parts to the various forms of wrench 100 described herein, and which have analogous functions. This includes movable jaw 120S, adjusting shaft 180, end grip 192S, frame 140S, fixed engagement faces 148, 204, movable engagement faces 124, 122 and threaded bore 152S. For compactness, bore 128S is oriented to be adjacent to movable jaw faces 122 and 124, repositioning shaft bore 152S adjacent to movable and fixed jaws 120S and 142S. A recess 272 is formed within the socket frame 140S, so that fingers can rotate grip 192S to rotate shaft 180 and change a position of movable jaw 120S. Rotation of grip 192S causes movable jaw to move towards or away from fixed engagement faces 148, 204, to engage a bolt head 302 as described elsewhere herein.

Figure 32:
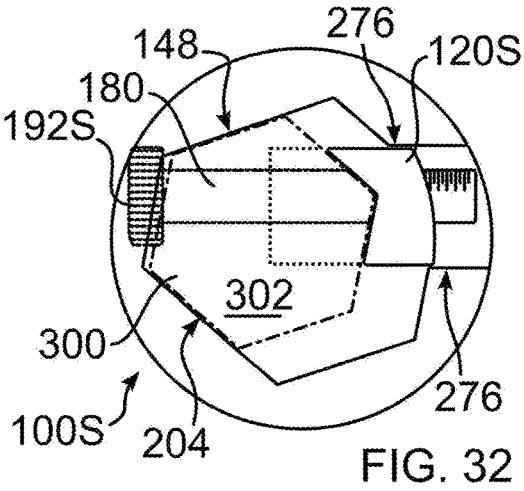
FIG. 32 is a bottom view of the socket of FIG. 30, illustrating engagement of a smaller bolt than is shown in FIG. 31.
Figure 31:
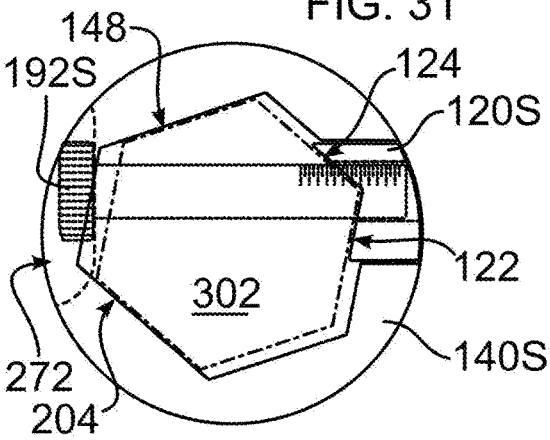
FIG. 31 is a bottom view of the socket of FIG. 30.
Figure 33:
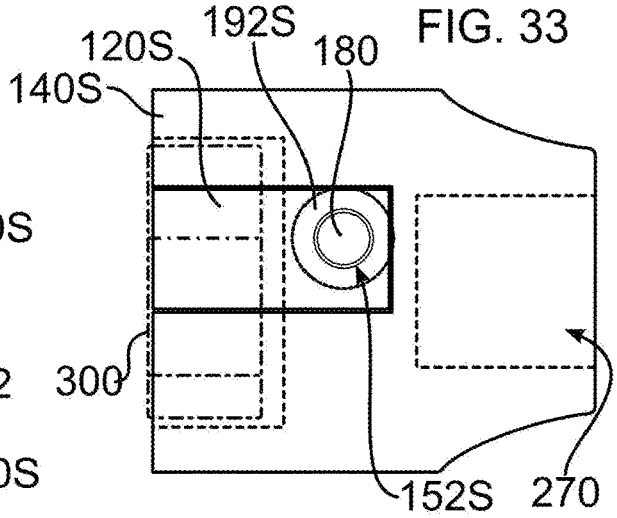
FIG. 33 is a side view of the socket of FIG. 30.
Figure 34:
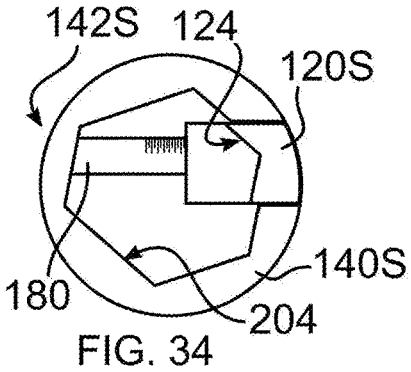
FIG. 34 is a bottom view of the socket of FIG. 30, with hidden lines removed.
Figure 35:
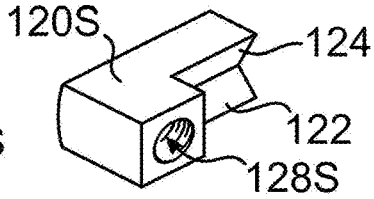
FIG. 35 is a perspective view of the movable jaw of the socket of FIG. 30.
Figure 37:
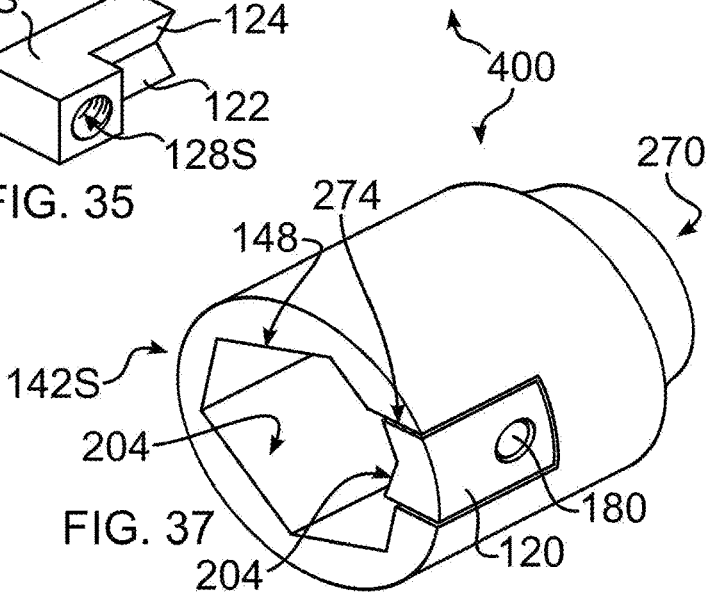
FIG. 37 is a perspective view of the socket of FIG. 30.
Figure 36:
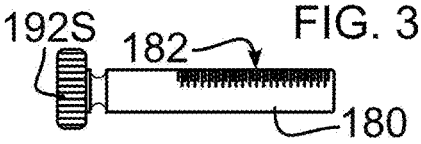
FIG. 36 depicts an adjusting shaft of the socket of FIG. 30.

A slot 274 is formed within socket frame 140S, and guides movement, and prevents rotation, of movable jaw 120S. Shaft 180 prevents tilting of movable jaw 120S. Threads 182 can be formed to limit axial movement of movable jaw 120S, or a land or other obstruction can be formed within frame 140S. FIG. 32 illustrates movable jaw 120S at a lower limit of movement, in this example, whereby movable jaw 120S remains in contact with at least one sidewall 276 of slot 274.

For compactness, it may be seen that shaft 180 is positioned alongside or side-by-side with movable jaw 120S, instead of in-line behind movable jaw 120S as in other embodiments herein. It should be noted, however, that this side-by-side arrangement can be carried out in the other embodiments, as well.

Figure 30:
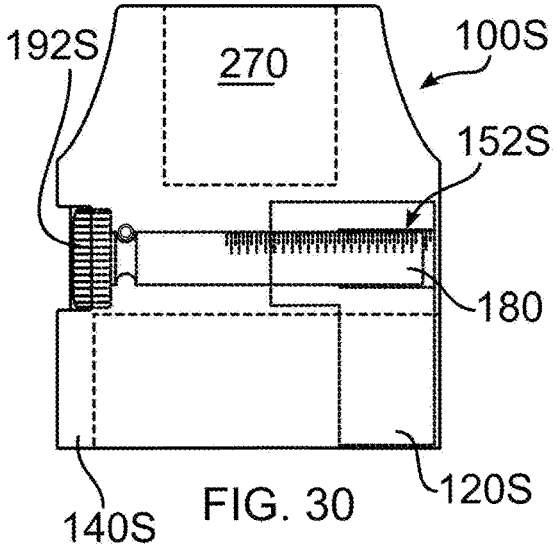
FIG. 30 is a hex head socket of the disclosure.

FIGS. 38-39 depict an alternative socket 100T of the disclosure, based upon socket wrench 100S of FIG. 30, but with a slot 170T formed in frame 140T adjacent to face 148T, forming an open-ended socket. As such, socket 100T can be moved sideways into engagement with a head 302 of a fastener 300. Socket 100U of FIGS. 41 and 41 is similar to that of FIGS. 38-39, except that a slot 170U is formed in frame 140U adjacent to face 204U, forming a flare-style socket 100U. In FIGS. 38-39, a line along which movable jaw 120T travels defines an angle of about 40.9 degrees with respect to a plane of face 148T, as detailed with respect to FIGS. 21A-21D. This is advantageous, as greater contact and purchase strength is afforded, particularly for counter-clockwise rotation, as viewed in FIG. 39. However, an angle of either about 19.1 degrees or 40.9 degrees can alternatively be formed, as illustrated in FIGS. 19-20 and 40-41, for either open-ended, closed, or flare style wrenches, including both socket style and non-socket style wrenches herein.

Referring now to FIGS. 42-43, a wrench 100W of the disclosure includes a wrench head 310 includes a movable jaw 312, a fixed jaw 314, a worm gear 316, and a shaft 318 extending from worm gear 316. A socket extension receiver/socket 320 is formed at an end of shaft 318 opposite the worm gear. Socket 320 is configured to receive a square ended standard socket extension 350 (FIG. 49) end 322, which can be ⅛, ¼, ⅜, ½, ¾, or 1 inch in size, for example, as well as non-square standards such as 9×12 mm. Such socket extensions can include a ball detent 324, which engages one or more detent openings 352 within socket 320, to retain the extension within socket 320 during use. As such, a socket extension 350 of any desired length or style can be inserted into socket 320 to form a connection with wrench head 310 which can be used to adjust a tension exerted upon a fastener head 302 by jaws 312 and 314. In addition, while maintaining this exerted tension, socket extension 350 can be used as a handle to simultaneously tension and rotate fastener head 302, as additionally described elsewhere herein.

In the embodiment shown in FIGS. 42-43, extension 320 includes a knurled end 324, although a widened handle, resembling that of FIG. 1 or as described elsewhere herein, can be formed for a more ergonomic grip. Other known or hereinafter developed standard or popular socket extensions can be used in accordance with the disclosure, with socket 320 adapted to be mateable therewith, either directly, or via an adapter. For example, known or hereinafter pivoting, rocking, or swiveling adapters can be used, or any other device which is insertable into a standard socket extension receiver/socket 320. Extensions can be selected for a length which facilitates accessing hard to reach locations, or to shorten an overall length of the wrench assembly. For example, in a hard to reach area, a swivel adapter can be used to enable pushing on an extension 350 to cause rotation of the connected wrench head, where the extension can be pushed or pulled orthogonally to an insertion angle to rotate the wrench head in either direction.

In FIG. 44, a wrench 100X is similar to that of FIG. 1, however shaft 180 is provided with a socket 320 formed on a free end thereof. In this manner, shaft 180 can be connected to an extension 350 of any type, as described above. While a wrench type similar to that of FIG. 1 is illustrated, other wrench embodiments described herein having a shaft 180 can be provided with a socket end as shown in FIG. 44, as described further elsewhere herein.

FIG. 45 illustrates that enlarged end grip 192 in any of the embodiments described here can be formed as grip 192A which includes a socket 320A formed within a free end thereof. In this manner, an ergonomic handle is always available, however a socket extension 350 can be provided when needed for additional leverage, or access to difficult to reach areas. An extension 350 can be provided for at least the purpose of providing a grip where no grip is provided with the wrench head, as illustrated in FIG. 44. A variety of grip styles can be provided, so that a user can choose a grip style that is preferred, for example flattened versus round, or a striking or impact surface of any of a variety of materials. FIG. 45 additionally illustrates that socket extensions which include a socket extension 320B can be used anywhere where a socket extension 350 is used, as described herein.

FIG. 46 depicts a locknut 280 which is threaded onto shaft 180 adjacent to frame 140. When a desired tension has been exerted upon fastener head 302 by fixed jaw 142 and movable jaw 120 by rotating shaft 180 as described herein, locknut can be rotated against frame 140 to secure shaft 180 from rotating and thereby reducing the exerted tension. An additional locknut 280 can be provided adjacent to the locknut 280 illustrated, to further lock a desired tension. Additionally or alternatively, a washer 282 can be provided to help retain an rotational alignment of locknut 280. For example, washer 282 can be fabricated with a material that is more resilient than that of frame 140 or locknut 280. Alternatively, a biasing washer 282A, as shown in FIG. 47, can be provided in place of washer 282, between frame 140 and locknut 280. In FIG. 47, a recess 284 is provided in frame 140, into which resilient wave shaped biasing washer 282A can be nested, to limit a tensioning force applied to biasing washer 282A. Locknut 280 can be used with any embodiments herein having a threaded shaft 180.

As mentioned above, any known method can be used to maintain shaft 180 in rotatable connection to movable jaw 120. An additional example is illustrated in FIG. 48. More particularly, bores 290 and 296 are formed in one or more surfaces of movable jaw 120 and frame 140, respectively. Spherical bearings 292 are deposited through bores 290, 296, to partially enter groove 188. A blocking element 294 is inserted into bore 290 via frame bores 296 to prevent bearings 292 from moving out of engagement with groove 188, while maintaining bearings 292 partially within bore 290, thereby rotatably retaining shaft 180 within movable jaw 120. Blocking element can be press fit into bore 290, for example as a pin, or can be threadably inserted, for example as a set screw. In a variation, bearings 292 are omitted, and blocking element 294 is inserted to extend into groove 188. In another variation, where the distance between bearing 292 and frame 140 is sufficiently small to prevent backing out of bearing 292 from groove 188, blocking element 294 can be omitted. In this variation, once movable jaw 120 has moved past bores 296, bearing 292 is trapped into engagement within groove 188.

With further reference to FIG. 48, and as discussed with respect to FIG. 7, slot 130 cooperates with frame bolt 154 to enable movement of moveably jaw 120 along a plane, into engagement or disengagement with fastener head 302. Engagement with shaft 180 prevents lateral movement of movable jaw 120. Accordingly, as mentioned elsewhere herein, and as depicted in FIG. 48, neither guide rail 146 or 146A is provided, and stabilization throughout the range of motion is provided by shaft 180 and frame bolt 154 and/or brace 162.

FIGS. 50-56 depict a prior art wrench head 328 and handle portion 330, connected to a prior art standard extension socket 320, to form a new wrench in accordance with the disclosure. While FIGS. 50-56 are illustrative, it should be understood that any standard wrench head can be combined, in accordance with the disclosure, to a standard extension socket 320, including but not limited to the examples of an open end, flare, monkey, box end, ratcheting box end, or ratcheting socket wrench head (FIGS. 52-56, respectively), or wrench heads of other known shapes. In this manner, a standard extension 350 (FIG. 49) having a shaft 354 of a desired length can be attached to the wrench head, and thus a handle with the desired leverage or working size can be reused with many different wrench heads configured in the manner of FIGS. 49-57. In addition, swivel or angled extension heads can be used, or extensions with widened ergonomic grips, as described elsewhere herein. While a portion of a standard wrench handle 330 is shown in FIGS. 49-57, it should be understood that handle 330 can be shorter, eliminated entirely, or can be longer than is depicted.

In FIG. 57, a wrench 100 of the disclosure is provided with a handle 330 of any desired length, which includes an extension socket 320 at a free end. Alternatively, extension socket 320 can be attached directly to frame 140 without an intervening handle 330. Any of the various embodiments of wrench 100 shown in FIGS. 1-41 and 46-48 herein can be provided with a handle 330 and socket 320 as illustrated in FIG. 57. In the embodiment shown, as described with respect to FIGS. 19-29, knob 192G can be provided to adjust movable jaw 120, and handle 330 (similar to handle 190H described elsewhere herein) extends separately.

By using a standard extension socket 320 on a prior art wrench head 328 or a wrench 100 of the disclosure, a toolkit can save space by including multiple wrench heads, each with a substantially shorter handle than would otherwise be needed for many applications requiring the leverage a longer handle would afford. However, the toolkit need only include a single standard socket extension 350, or socket extensions 350 of varying sizes, which can be used with a plurality of wrench heads. In addition, the various forms of socket extensions can be used to access locations which would otherwise be difficult, including swiveling socket extensions, for example of the type including a u-joint, or extensions including a dog-leg or offset portion.

Wrenches of the disclosure can be made of any material with sufficient hardness, durability, and strength for a particular application, as well as resistance to damage due to liquids or other substances found within a particular use context. Materials can include metal or plastic, or a composite material, for example. Some or all of a wrench of the disclosure can be made by casting, forging, machining, molding, stamping, grinding, 3D printing, extrusion, welding, brazing, or any other manufacturing method appropriate to the shapes shown and described, with consideration to hardness, durability, and strength, as well as attractiveness and precision. Some or all of the components shown and described can be provided with an attractive and durable finish, such as by chroming, painting, coating, knurling or stamping.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. An adjustable wrench, comprising:

a wrench head frame having a gap forming an open-ended wrench;

a fixed jaw face fixedly positioned upon the frame directly adjacent to the gap and having a planar fastener engaging surface;

a movable jaw having first and second movable jaw faces forming an angle of about 120 degrees relative to each other, each of the first and second movable jaw faces having a planar fastener engaging surface, the first movable jaw face directly adjacent the gap;

a guide connected to the frame and the movable jaw to control movement of the movable jaw towards or away from the fixed jaw face along a movement line;

the movement line passing through the planar fastener engaging surface of the fixed jaw face at an angle of about 40.9 degrees; and the fixed jaw face and the first movable jaw face parallel to each other; and a shaft threadably engaged with the frame and connected to the movable jaw, the shaft extending away from the frame and coaxial with the movement line, the shaft rotatable in a first direction to move the movable jaw away from the fixed jaw, and rotatable in a second direction opposite to the first direction to move the movable jaw towards the fixed jaw;

the movable jaw positioned to push a fastener against the fixed jaw face when the shaft is rotated in the second direction and the fastener is positioned between the movable jaw and the fixed jaw face.

2. The wrench of claim 1, the planar fastener engaging surface of the first movable jaw face remaining parallel to the planar fastener engaging surface of the fixed jaw face as the movable jaw is moved.

3. The wrench of claim 1, further including a widened portion at a free end of the shaft that is distal from the fixed jaw face, the widened portion sized and dimensioned to be grasped by a hand of a user of the wrench.

4. The wrench of claim 1, the shaft including a free end that is distal to the fixed jaw face, a portion of the shaft that is rotatable within the frame being an end opposite the free end.

5. The wrench of claim 4, further including a socket comprising a square female receptacle configured to receive a driver, the socket formed within the free end.

6. The wrench of claim 5, wherein the socket is sized to receive one of a ⅛, ¼, ⅜, ½, ¾, or 1 inch driver.

7. The wrench of claim 1, the guide further including a channel formed in at least one of the frame and movable jaw, and a projection formed upon the other of the frame and movable jaw, the projection and channel forming a mating slideable connection.

8. The wrench of claim 1, wherein the guide further includes a slot within the frame within which the movable jaw is slideably retained.

9. The wrench of claim 1, an end of the shaft rotatably received within the movable jaw.

10. The wrench of claim 1, wherein the shaft extends from the frame to form a handle graspable by a user of the wrench to rotate the wrench in engagement with the fastener to loosen or tighten the fastener.

11. The wrench of claim 1, wherein when the shaft is rotated in the first direction, the shaft extends further from the frame to increase an overall length of the wrench and handle and to thereby increase leverage of the handle.

12. The wrench of claim 1, the shaft having a socket comprising a square female receptacle positioned at a free end of the shaft that is distal from the fixed jaw face.

13. An adjustable wrench, comprising:

a wrench head frame having a gap forming an open-ended wrench;

a fixed jaw face fixedly positioned upon the frame directly adjacent to the open-end gap and having a planar fastener engaging surface;

a movable jaw having first and second movable jaw faces forming an angle of about 120 degrees relative to each other, each of the first and second movable jaw faces having a planar fastener engaging surface, the first movable jaw face directly adjacent the gap;

a guide connected to the frame and the movable jaw to control movement of the movable jaw towards or away from the fixed jaw face along a movement line;

the fixed jaw face forming an angle of about 40.9 degrees with respect to an intersection of the movement line and a plane upon which the planar fastener engaging surface of the fixed jaw face lies;

the first movable jaw face forming an angle of about 40.9 degrees with respect to an intersection of the movement line and a plane upon which the planar fastener engaging surface of the first movable jaw face lies;

the fixed jaw face and the first movable jaw face parallel to each other; and a shaft threadably engaged with the frame and rotatably connected to the movable jaw, the shaft extending away from the frame, the shaft rotatable in a first direction to move the movable jaw away from the fixed jaw, and rotatable in a second direction opposite to the first direction to move the movable jaw towards the fixed jaw;

the wrench defining a longitudinal length extending from the fixed jaw face and along the shaft to a distal end of the wrench furthest from the fixed jaw face;

the shaft extending further from the frame when the shaft is rotated in the first direction to thereby increase the longitudinal length of the wrench and to thereby increase leverage of the wrench as a larger fastener is engaged.

* * * * *